US009004637B2

(12) United States Patent
Hattori et al.

(10) Patent No.: US 9,004,637 B2
(45) Date of Patent: Apr. 14, 2015

(54) IMAGE FORMING APPARATUS AND IMAGE FORMING METHOD

(71) Applicant: FUJIFILM Corporation, Tokyo (JP)

(72) Inventors: Kazumasa Hattori, Kanagawa (JP); Jun Yamanobe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/958,236

(22) Filed: Aug. 2, 2013

(65) Prior Publication Data

US 2014/0063101 A1 Mar. 6, 2014

(30) Foreign Application Priority Data

Aug. 28, 2012 (JP) ..... 2012-187682

(51) Int. Cl.
*B41J 2/12* (2006.01)
*B41J 2/21* (2006.01)

(52) U.S. Cl.
CPC . *B41J 2/12* (2013.01); *B41J 2/2142* (2013.01)

(58) Field of Classification Search
CPC ..... B41J 2/12
See application file for complete search history.

(56) References Cited

U.S. PATENT DOCUMENTS

| | | | | |
|---|---|---|---|---|
| 8,496,313 | B2 | 7/2013 | Ueshima | |
| 2007/0085866 | A1* | 4/2007 | Vladislav et al. | 347/9 |
| 2011/0141178 | A1* | 6/2011 | Kawai et al. | 347/14 |
| 2011/0234673 | A1* | 9/2011 | Ueshima | 347/14 |
| 2012/0062643 | A1* | 3/2012 | Ito | 347/19 |

FOREIGN PATENT DOCUMENTS

| | | | |
|---|---|---|---|
| JP | 2007-118446 | A | 5/2007 |
| JP | 2011-201121 | A | 10/2011 |

* cited by examiner

*Primary Examiner* — Manish S Shah
*Assistant Examiner* — Jeremy Delozier
(74) *Attorney, Agent, or Firm* — Studebaker & Brackett PC

(57) ABSTRACT

An image forming apparatus includes a discharge disabling unit configured to disable a discharge operation of a defective nozzle, which is in a defective discharge state, among a plurality of nozzles configured to discharge liquid droplets to a recording medium, when a value obtained by quantifying a degree of defective state of the defective nozzle is greater than a discharge disable threshold value; a complement unit configured to complement an image defect using two nozzles on either side of the defective nozzle of which discharge operation is disabled; and a threshold value change unit configured to change the discharge disable threshold value depending on a discharge order between the nozzles which complement the image defect and nozzles adjacent to the nozzles which complement the image defect.

12 Claims, 13 Drawing Sheets

FIG. 5

| i | ADDRESS | AMOUNT OF DEVIATION Δ(i) OF LANDING POSITION | TWO NOZZLES BOTH DISCHARGE LIQUID DROPLETS EARLY | TWO NOZZLES HAVE DIFFERENT DISCHARGE ORDERS | TWO NOZZLES BOTH DISCHARGE LIQUID DROPLETS LATE |
|---|---|---|---|---|---|
| 1 | A1 | 0.0 | | ○ | |
| 2 | A2 | 0.1 | | ○ | |
| 3 | A3 | 7.3 | | ○ | |
| 4 | A4 | 0.0 | | ○ | |
| 5 | A5 | 0.2 | | | ○ |
| 6 | A6 | 0.0 | | ○ | |
| 7 | B1 | 1.0 | | ○ | |
| 8 | B2 | 1.1 | ○ | | |
| 9 | B3 | 0.1 | | ○ | |
| 10 | B4 | 2.3 | | ○ | |
| 11 | B5 | 11.2 | | | ○ |
| 12 | B6 | 0.0 | | ○ | |
| 13 | C1 | 0.0. | | ○ | |
| 14 | C2 | 5.4 | ○ | | |
| ⋮ | ⋮ | ⋮ | ⋮ | ⋮ | ⋮ |

(FIG. 8 Continued)
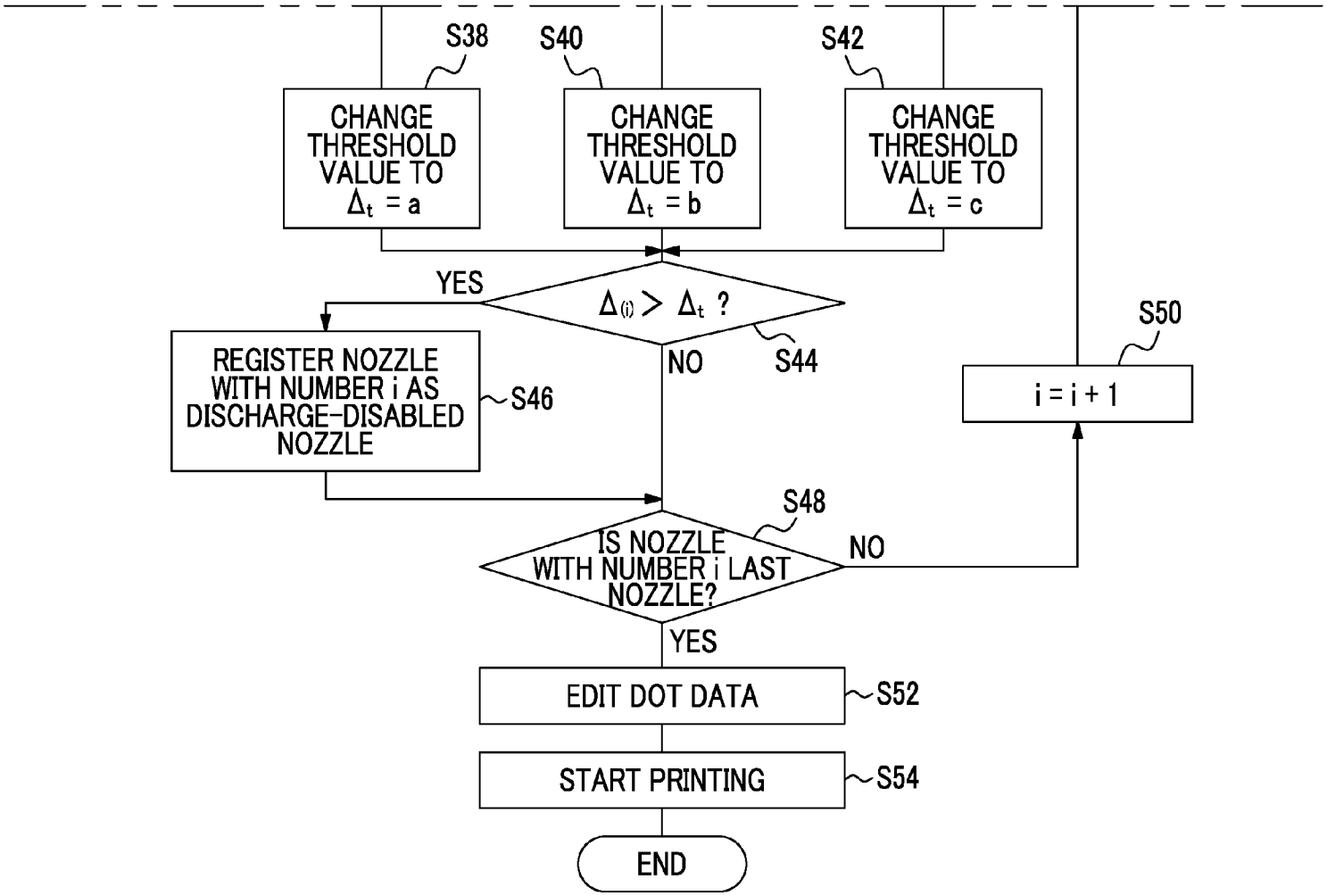

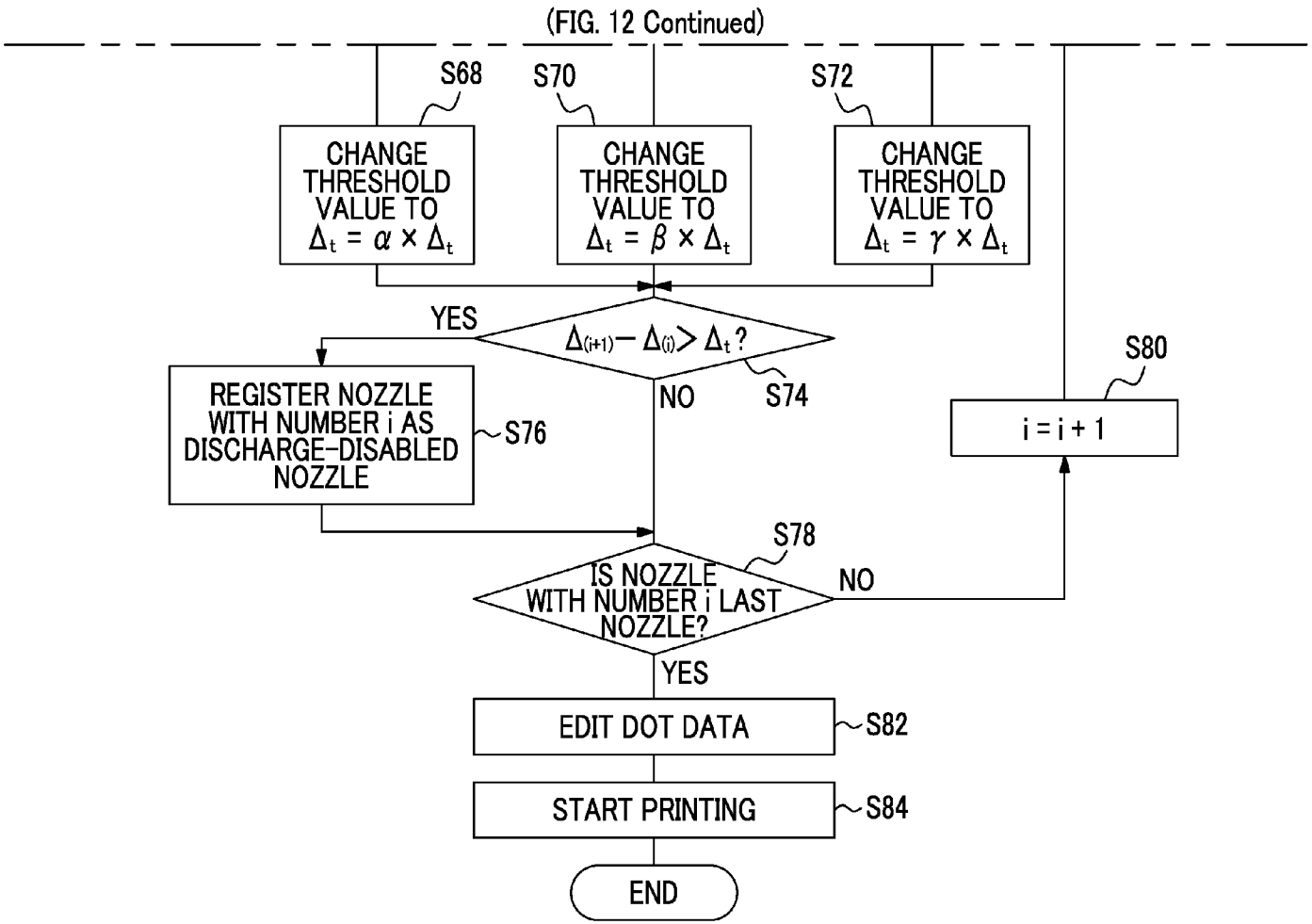
(FIG. 12 Continued)
S68
CHANGE THRESHOLD VALUE TO $\Delta_t = \alpha \times \Delta_t$
S70
CHANGE THRESHOLD VALUE TO $\Delta_t = \beta \times \Delta_t$
S72
CHANGE THRESHOLD VALUE TO $\Delta_t = \gamma \times \Delta_t$
S74
$\Delta_{(i+1)} - \Delta_{(i)} > \Delta_t$ ?
YES
NO
S76
REGISTER NOZZLE WITH NUMBER i AS DISCHARGE-DISABLED NOZZLE
S78
IS NOZZLE WITH NUMBER i LAST NOZZLE?
YES
NO
S80
i = i + 1
S82
EDIT DOT DATA
S84
START PRINTING
END

IMAGE FORMING APPARATUS AND IMAGE FORMING METHOD

BACKGROUND OF THE INVENTION

1. Field of the Invention

The present invention relates to an image forming apparatus of a liquid droplet discharge recording type and an image forming method.

2. Description of the Related Art

In recent years, as an image forming apparatus, an image forming apparatus of a liquid droplet discharge recording type has been known which transports a sheet with respect to a liquid droplet discharge head including a plurality of nozzles and discharges liquid droplets, such as ink droplets, from the nozzles to the sheet to form an image on the sheet.

In these type of image forming apparatuses, there is an image forming apparatus in which, when the number of times the liquid droplets are discharged from the nozzle reaches a fixed threshold value, the discharge operation of a nozzle is disabled (the nozzle is not used), and two nozzles adjacent to the disabled nozzle are used to complement an image defect (for example, JP2007-118446A).

However, in some cases, even when the image defect is uniformly complemented by the two nozzles adjacent to the discharge-disabled nozzle, a white line is generated in the image to be formed.

JP2011-201121A discloses an image forming apparatus which changes the size of liquid droplets depending on the discharge order of two nozzles adjacent to a nozzle in a discharge defective state and nozzles adjacent to the outside of the two adjacent nozzles and performs a complementary process using the two adjacent nozzles.

SUMMARY OF THE INVENTION

However, in the structure disclosed in JP2011-201121A, after the discharge operation of the defective nozzles are uniformly disabled, the complementary process is performed. Therefore, the large number of nozzles may be subject to the complementary process and the load of the complementary process may be heavy. As a result, there is a concern that a white line will be generated in the image to be formed.

The invention has been made in view of the above-mentioned problems and an object of the invention is to provide an image forming apparatus and an image forming method capable of preventing white lines from being formed when there is a nozzle in a discharge defective state.

The above-mentioned object of the invention is achieved by the following means.

According to a first aspect of the invention, an image forming apparatus includes: a discharge disabling unit configured to disable a discharge operation of a defective nozzle, which is in a defective discharge state, among a plurality of nozzles configured to discharge liquid droplets to a recording medium, when a value obtained by quantifying a degree of defective state of the defective nozzle is greater than a discharge disable threshold value; a complement unit configured to complement an image defect using two nozzles on either side of the defective nozzle of which discharge operation is disabled; and a threshold value change unit configured to change the discharge disable threshold value depending on a discharge order between the nozzles which complement the image defect and nozzles adjacent to the nozzles which complement the image defect.

According to this configuration, since the threshold value change unit changes the discharge disable threshold value depending on the discharge order of the nozzles, it is possible to reduce the number of discharge-disabled nozzles, as compared to the configuration in which the discharge disabling unit uniformly disables the discharge operation of the nozzles in the defective discharge state using the fixed discharge disable threshold value. When the discharge disable threshold value is changed in such a manner that the number of discharge-disabled nozzles is reduced, it is possible to reduce the load of the complementary process and thus prevent white lines from being formed when a nozzle in a defective discharge state is present.

According to a second aspect of the invention, the image forming apparatus according to the first aspect may further include a quantification unit configured to detect the defective nozzle among the plurality of nozzles and to quantify the degree of defective state of the defective nozzle. When the two nozzles on either side of the defective nozzle both discharge the liquid droplets later than the nozzles adjacent to the two nozzles on either side of the defective nozzle, the threshold value change unit may change the discharge disable threshold value to be greater than that when the two nozzles on either side of the defective nozzle both discharge the liquid droplets earlier than the nozzles adjacent to the two nozzles on either side of the defective nozzle.

When the two nozzles on either side of the defective nozzle, which two nozzles complement the image defect, both discharge the liquid droplets later than the nozzles adjacent to the two nozzles on either side of the defective nozzle, the liquid droplet which is discharged later is coagulated with the liquid droplet which is discharged earlier from the nozzle adjacent to the two nozzles on either side of the defective nozzle and the greater number of white lines may be generated after the complement process than when the two nozzles which complement the image defect on the either side of the defective nozzle, both discharge the liquid droplets earlier than the nozzles adjacent to the two nozzles on either side.

In the second aspect, in the case where the liquid droplets are discharged later from the two nozzles on either side of the defective nozzle than the nozzles adjacent to the two nozzles on either side of the defective nozzle, in which case a large number of white lines are likely to be formed, the threshold value change unit changes the discharge disable threshold value to be greater than that in the case where the liquid droplets are discharged earlier from the two nozzles on either side of the defective nozzle than the nozzles adjacent to the two nozzles on either side. Accordingly, the discharge disabling unit does not disable the discharge operation of the defective nozzle which is sandwiched between the two nozzles which discharge the liquid droplets later than the nozzles adjacent to the two nozzles. Therefore, the liquid droplets are discharged from the defective nozzle which is sandwiched between two nozzles which discharge the liquid droplets later and the complementary process is not performed. As a result, it is possible to prevent the generation of white lines, as compared to when the complementary process is performed.

According to a third aspect of the invention, in the image forming apparatus according to the second aspect, when one of the two nozzles on either side of the defective nozzle discharges the liquid droplets earlier than the nozzle adjacent to the one of the two nozzles on either side of the defective nozzle and an other of the two nozzles on either side of the defective nozzle discharges the liquid droplets later than the nozzle adjacent to the other one of the two nozzles on either side of the defective nozzle, the threshold value change unit may change the discharge disable threshold value to be greater than that when the two nozzles on either side of the defective nozzle both discharge the liquid droplets earlier than the nozzles adjacent to the two nozzles on either side of the defective nozzle and to be less than that when the two nozzles on either side of the defective nozzle both discharge the liquid droplets later than the nozzles adjacent to the two nozzles on either side of the defective nozzle.

When one of the two nozzles which complement the image defect on either side of the defective nozzle, discharges the liquid droplet earlier than the nozzle adjacent to the one of the two nozzles on either side of the defective nozzle and the other of two nozzles on either side of the defective nozzle discharges the liquid droplet later than the nozzle adjacent to the other one of the two nozzles on either side of the defective nozzle, the number of white lines generated may be more than that when the two nozzles which complement the image defect on either side of the defective nozzle both discharge the liquid droplets earlier and is less than that when the two nozzles which complement the image defect on either side of the defective nozzle both discharge the liquid droplets later.

Therefore, in the third aspect, when one of the two nozzles which complement the image defect on either side of the defective nozzle, discharges the liquid droplet earlier than nozzle adjacent the two nozzle on either side and the other of two nozzles on either side discharges the liquid droplet later than the nozzle adjacent to the other one of the two nozzles on either side, the threshold value change unit changes the discharge disable threshold value to be greater than that when the two nozzles on either side both discharge the liquid droplets earlier than the nozzles adjacent to the two nozzles on either side and to be less than that when the two nozzles on either side both discharge the liquid droplets later than the nozzles adjacent to the two nozzles on either side.

Therefore, the discharge disabling unit does not disable the discharge operation of the defective nozzle which is sandwiched between two nozzles, one of which two nozzles discharging the liquid droplet earlier than the nozzle adjacent to the one of the two nozzle and the other of the two nozzles discharging the liquid droplet later than the nozzle adjacent to the other one of the two nozzle. As a result, it is possible to prevent white lines from being formed.

According to a fourth aspect of the invention, in the image forming apparatus according to the second aspect or the third aspect, the quantification unit may quantify an amount of deviation of a landing position of the liquid droplet on the recording medium as the degree of defective state of the defective nozzle.

According to this configuration, the discharge disabling unit disables the discharge operation of the nozzle when the amount of deviation of the landing position of the liquid droplet discharged from the nozzle is greater than the discharge disable threshold value.

According to a fifth aspect of the invention, in the image forming apparatus according to the second aspect or the third aspect, the quantification unit may quantify a difference between an amount of deviation of a landing position of the liquid droplet on the recording medium and the amount of deviation of a landing position of the liquid droplet adjacent to the landing position as the degree of the defective state of the defective nozzle.

According to this configuration, the discharge disabling unit disables the discharge operation of the nozzle when the difference between the amount of deviation of the landing position of the liquid droplet discharged from the nozzle onto the recording medium and the amount of deviation of the landing position of the liquid droplet adjacent to the landing position is greater than the discharge disable threshold value.

According to a sixth aspect of the invention, in the image forming apparatus according to the fourth aspect, when the amount of deviation of the landing position of the liquid droplet discharged from an i-th nozzle among the plurality of nozzles is $\Delta_{(i)}$, an initial value of the discharge disable threshold value $\Delta_t$ is $\Delta_s$, rates of increase of the discharge disable threshold value are $\alpha$, $\beta$ and $\gamma$, $\alpha<\beta<\gamma$ is satisfied, and $\alpha$ is 1, the threshold value change unit may change the discharge disable threshold value to $\Delta_t=\alpha\times\Delta_s$ if the two nozzles on either side of the defective nozzle both discharge the liquid droplets earlier than the nozzles adjacent to the two nozzles on either side of the defective nozzle, changes the discharge disable threshold value to $\Delta_t=\beta\times\Delta_s$ if one of the two nozzles on either side of the defective nozzle discharges the liquid droplets earlier than the nozzle adjacent to the one of the two nozzles on either side of the defective nozzle and the other of the two nozzles on either side of the defective nozzle discharges the liquid droplets later than the nozzle adjacent to the other one of the two nozzles on either side of the defective nozzle, and changes the discharge disable threshold value to $\Delta_t=\gamma\times\Delta_s$ if the two nozzles on either side of the defective nozzle both discharge the liquid droplets later than the nozzles adjacent to the two nozzles on either side of the defective nozzle. The discharge disabling unit may disable the discharge operation of the i-th nozzle when $\Delta_{(i)}>\Delta_t$ is satisfied.

According to this configuration, the discharge disable threshold value is changed to be sequentially increased in order of when the two nozzles on either side of the defective nozzle, which complement the image defect, both discharge the liquid droplets earlier than the nozzles adjacent to the two nozzles on either side, when the two adjacent nozzles both discharge the liquid droplets later than the nozzles adjacent to the two nozzles on either side, and when one of the two nozzles on either side discharges the liquid droplets earlier than the nozzle adjacent to the one of the two nozzles on either side and the other of the two nozzles on either side discharges the liquid droplets later than the other one of the two nozzles on either side. That is, the discharge disable threshold value is changed to be sequentially increased to $\Delta_t=\alpha\times\Delta_s$, $\Delta_t=\beta\times\Delta_s$, and $\Delta_t=\gamma\times\Delta_s$ ($\alpha<\beta<\gamma$; $\alpha=1$) in order. Therefore, it is possible to reduce the number of nozzles disabled by the discharge disabling unit and prevent white lines from being formed.

According to a seventh aspect of the invention, in the image forming apparatus according to the fifth aspect, when the amount of deviation of the landing position of the liquid droplet discharged from an i-th nozzle among the plurality of nozzles is $\Delta_{(i)}$, a dot diameter of the liquid droplet is $\phi(2r)$, a distance between the nozzles is L, the rates of increase of the discharge disable threshold value $\Delta_t$ are $\alpha$, $\beta$ and $\gamma$, $\alpha<\beta<\gamma$ is satisfied, and $\alpha$ is 1, the threshold value change unit may change the discharge disable threshold value to $\Delta_t=\alpha\times(\phi(2r)-L)$ if the two nozzles on either side of the defective nozzle both discharge the liquid droplets earlier than the nozzles adjacent to the two nozzles on either side of the defective nozzle, changes the discharge disable threshold value to $\Delta_t=\beta\times(\phi(2r)-L)$ if one of the two nozzles on either side of the defective nozzle discharges the liquid droplets earlier than the nozzle adjacent to the one of the two nozzles on either side of the defective nozzle and the other of the two nozzles on either side of the defective nozzle discharges the liquid droplets later than the nozzle adjacent to the other one of the two nozzles on either side of the defective nozzle, and changes the discharge disable threshold value to $\Delta_t=\gamma\times(\phi(2r)-L)$ if the two nozzles on either side of the defective nozzle both discharge the liquid droplets later than the nozzles adjacent to the two nozzles on either side of the defective nozzle. The discharge disabling unit may disable the discharge operation of the i-th nozzle when $\Delta_{(i+1)}-\Delta_{(i)}>\Delta_t$ is satisfied.

According to this configuration, the discharge disable threshold value is changed to be sequentially increased in order of when the two nozzles which complement the image defect on either side of the defective nozzle, both discharge the liquid droplets earlier than the nozzles adjacent to the two nozzles on either side of the defective nozzle, when the two nozzles on either side both discharge the liquid droplets later than the nozzles adjacent to the two nozzles on either side, and when one of the two nozzles on either side discharges the liquid droplets earlier than the nozzle adjacent to the one of the two nozzles on either side and the other of the two nozzles on either side discharges the liquid droplets later than the nozzle adjacent to the other one of the two nozzle on either side. That is, the discharge disable threshold value is changed to be sequentially increased to $\Delta_t=\alpha\times(\phi(2r)-L)$, $\Delta_t=\beta\times(\phi(2r)-L)$, and $\Delta_t=\gamma\times(\phi(2r)-L)$ ($\alpha<\beta<\gamma$; $\alpha=1$) in order. Therefore, it is possible to reduce the number of nozzles disabled by the discharge disabling unit and prevent white lines from being formed.

According to an eighth aspect of the invention, an image forming method includes: detecting a defective nozzle, which is in a defective discharge state, among a plurality of nozzles configured to discharge liquid droplets to a recording medium; quantifying a degree of defective state of the defective nozzle; disabling a discharge operation of the defective nozzle when a value obtained by quantifying the degree of the defective state of the defective nozzle is greater than a discharge disable threshold value; complementing an image defect using two nozzles on either side of the defective nozzle of which discharge operation is disabled; and changing the discharge disable threshold value depending on a discharge order between the two nozzles which complement the image defect and nozzles adjacent to the two nozzles which complement the image defect, before the disabling of the discharge operation.

According to this method, in the changing of the threshold value, the discharge disable threshold value is changed depending on the discharge order. Therefore, it is possible to reduce the number of nozzles whose discharge operation is disabled, as compared to the configuration in which the discharge operation of the nozzles which are in a defective discharge state are uniformly disabled using the fixed discharge disable threshold value in the discharge disabling process. As a result, it is possible to reduce the load of a complementary process and prevent white lines from being formed when a nozzle in a defective discharge state is present.

According to the above-mentioned aspects of the invention, it is possible to prevent white lines from being formed when a nozzle in a defective discharge state is present.

BRIEF DESCRIPTION OF THE DRAWINGS

FIG. 5 is a diagram illustrating a table stored in a storage unit.

FIG. 6A is an exemplary schematic diagram illustrating a case in which the two nozzles both discharge liquid droplets earlier than the nozzles adjacent to the two nozzles; FIG. 6B is an exemplary schematic diagram illustrating a case in which the two nozzles both discharge liquid droplets later than the nozzles adjacent to the two nozzles; and FIG. 6C is an exemplary schematic diagram illustrating a case in which the two nozzles have different discharge orders.

FIG. 9A is an exemplary schematic diagram illustrating a state in which the complementary process has not been performed for the discharge-disabled nozzle; and FIG. 9B is an exemplary schematic diagram illustrating a state in which the complementary process has been performed for the discharge-disabled nozzle.

FIG. 10A is an exemplary schematic diagram illustrating a case in which the two nozzles on either side of the discharge-disabled nozzle both discharge liquid droplets later than the nozzles adjacent to the two nozzles; and FIG. 10B is an exemplary schematic diagram illustrating a case in which the two nozzles on either side of the discharge-disabled nozzle both discharge liquid droplets earlier than the nozzles adjacent to the two nozzles.

DESCRIPTION OF THE PREFERRED EMBODIMENTS

First Embodiment

Hereinafter, an image forming apparatus and an image forming method according to a first embodiment of the invention will be described in detail with reference to the accompanying drawings.

—Overall Structure of Ink Jet Recording Apparatus—

Figure 1:
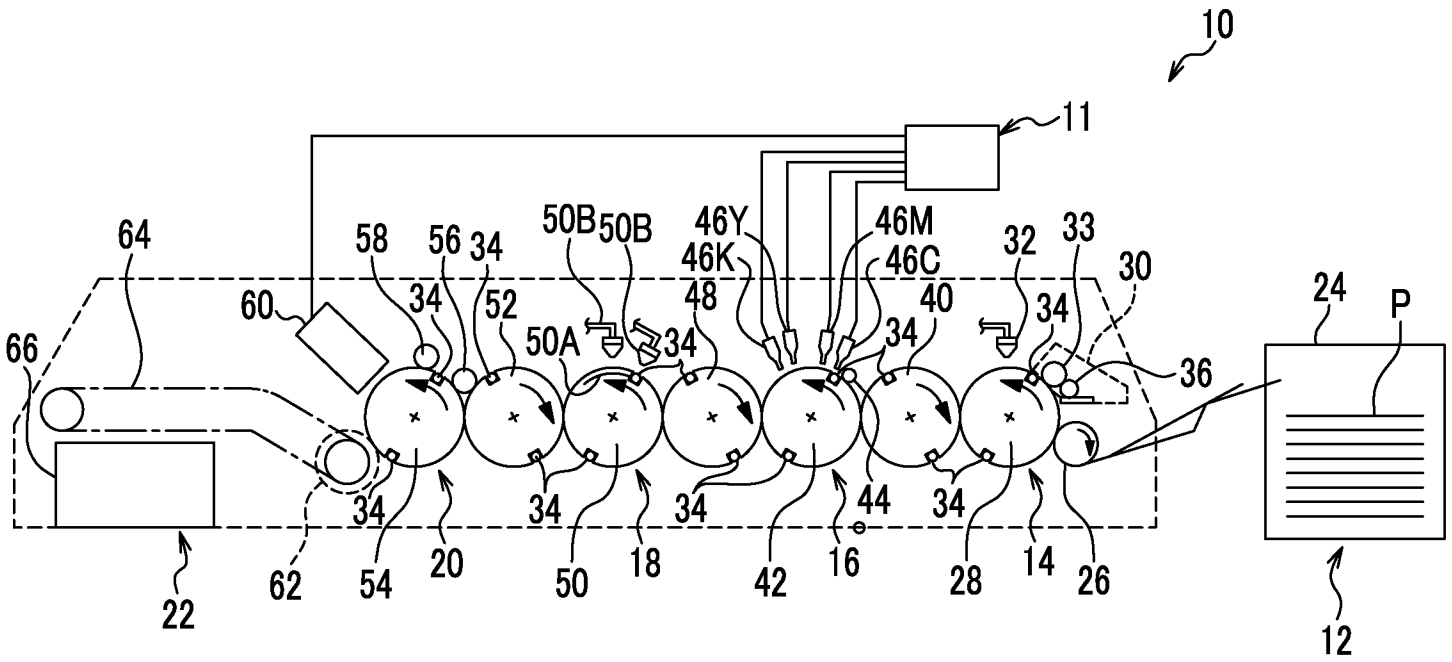
FIG. 1 is an exemplary schematic diagram illustrating the overall structure of an ink jet recording apparatus which is an example of an image forming apparatus according to a first embodiment of the invention.

FIG. 1 is a schematic diagram illustrating the overall structure of an ink jet recording apparatus 10 as an example of the image forming apparatus according to the first embodiment of the invention.

The ink jet recording apparatus 10 is a two-liquid coagulation-type recording apparatus which forms an image using ink droplets including a color material and a processing liquid including a component for coagulating the ink droplets.

The ink jet recording apparatus 10 mainly includes a sheet feed unit 12, a processing liquid applying unit 14, an image forming unit 16, a dry unit 18, a fixing unit 20, and a sheet discharge unit 22 and sequentially transports a sheet P serving as a recording medium from the sheet feed unit 12 to the sheet discharge unit 22 to form an image.

The sheet feed unit 12 includes a sheet feed tray 24 and the sheets P are stacked in the sheet feed tray 24. The sheet feed unit 12 is provided with a transport mechanism (not shown), takes out the sheets P stacked in the sheet feed tray 24 one by one from the sheet feed tray 24, and transports the sheets to a sheet feed drum 26 which is rotatably provided. The sheet P sent to the sheet feed drum 26 is transported to the processing liquid applying unit 14 along the outer circumferential surface of the sheet feed drum 26.

The processing liquid applying unit 14 includes a processing liquid applying drum 28. The sheet P transported to the processing liquid applying unit 14 is held by grippers 34 formed on the outer circumferential surface of the processing liquid applying drum 28 which is rotatably provided and is then transported in the direction of an arrow shown in FIG. 1. The grippers 34 are formed at positions which are separated by 180 degrees in the circumferential direction of the processing liquid applying drum 28 and transport the sheet P so as to be attached to the outer circumferential surface of the processing liquid applying drum 28, with the end of the sheet P interposed therebetween. The other drums, which will be described below, have the same structure as the processing liquid applying drum 28.

The processing liquid applying unit 14 includes a processing liquid applying device 30 and a warm air generating device 32 which are arranged in this order from the upstream side in the transport direction of the sheet P along the outer circumferential surface of the processing liquid applying drum 28. The processing liquid applying device 30 includes a first roller 36 which is partially immersed in the processing liquid and a second roller 38 which comes into contact with the first roller. The second roller 38 comes into pressure contact with the sheet P and the processing liquid applying drum 28 and the second roller 38 are relatively rotated to apply the processing liquid onto the sheet P.

The sheet P having the processing liquid applied thereon passes below the warm air generating device 32 which is provided above the processing liquid applying drum 28. In this case, the warm air generating device 32 which is adjusted to a fixed temperature blows warm air to the sheet P to dry the sheet P. In this way, the phenomenon in which the color material floats is prevented.

Then, the sheet P is transported to the image forming unit 16 through a transport drum 40. The image forming unit 16 includes an image forming drum 42, holds the sheet P transported from the transport drum 40, and transports the sheet P in the direction of an arrow shown in FIG. 1. In addition, the image forming unit 16 includes a guide roller 44 and ink jet recording heads 46C, 46M, 46Y, and 46K which are arranged in this order from the downstream side in the transport direction of the sheet P along the outer circumferential surface of the image forming drum 42.

The guide roller 44 comes into contact with the image forming drum 42. When the sheet P passes between the image forming drum 42 and the guide roller 44, the guide roller 44 presses the sheet P to the image forming drum 42 so as to come into close contact with the image forming drum 42. The sheet P which comes into close contact with the image forming drum 42 by the guide roller 44 is transported below the ink jet recording heads 46C, 46M, 46Y, and 46K.

The ink jet recording heads 46C, 46M, 46Y, and 46K correspond to four color ink droplets, that is, cyan, magenta, yellow, and black ink droplets, respectively, and are attached such that the bottoms (nozzle planes) of the ink jet recording heads 46C, 46M, 46Y, and 46K are parallel to the sheet P transported to the image forming drum 42. In the following description, when the colors of the ink jet recording heads 46C, 46M, 46Y, and 46K are not specified, the ink jet recording heads 46C, 46M, 46Y, and 46K are simply referred to as ink jet recording heads 46.

The ink jet recording head 46 is a so-called full line head which extends to the maximum width of an image forming region of the sheet P in the axial direction of the image forming drum 42. Therefore, an image is formed by a single path method in which the ink jet recording head 46 is not moved in the width direction of the sheet P.

Figure 2:
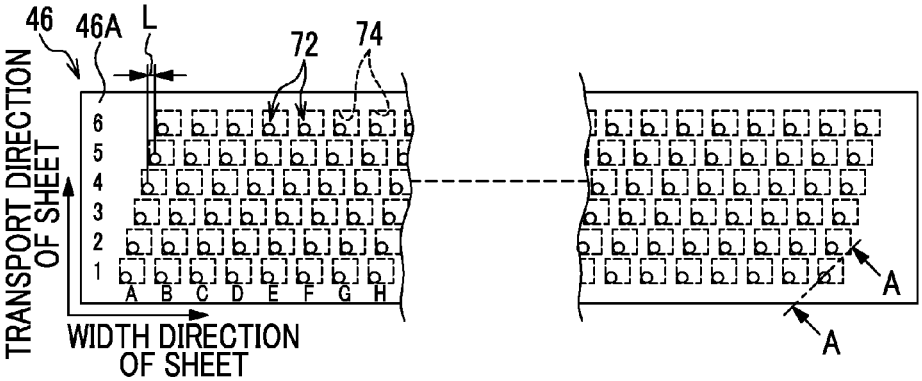
FIG. 2 is an exemplary plan view illustrating the arrangement of nozzles in an ink jet recording head according to the first embodiment.

As shown in FIG. 2, a plurality of nozzles 72 are formed in a nozzle plane 46A of the ink jet recording head 46. The nozzles 72 are arranged at equal intervals in the width direction of the sheet P and include nozzle rows which are formed to the maximum width of the image forming region of the sheet P. Six nozzle rows are formed at equal intervals in the transport direction of the sheet P. The nozzle rows which are formed in the transport direction of the sheet P are shifted by pitches L in the width direction of the sheet P toward the downstream side in the transport direction of the sheet P.

Here, addresses are given to all of the nozzles 72. In this embodiment, the addresses are given to all of the nozzles 72 using alphabets (A, B, C, . . . ) which are sequentially set from the left side in the width direction of the sheet P and numbers (1, 2, 3, . . . ) which are sequentially set from the upstream side to the downstream side in the transport direction of the sheet P. For example, in FIG. 2, the address of the lower left nozzle 72 is A1. In addition, serial numbers starting from 1 are sequentially given to each address from the address A1. For example, the address A6 has number 6 and the address B1 has serial number 7.

Figure 3:
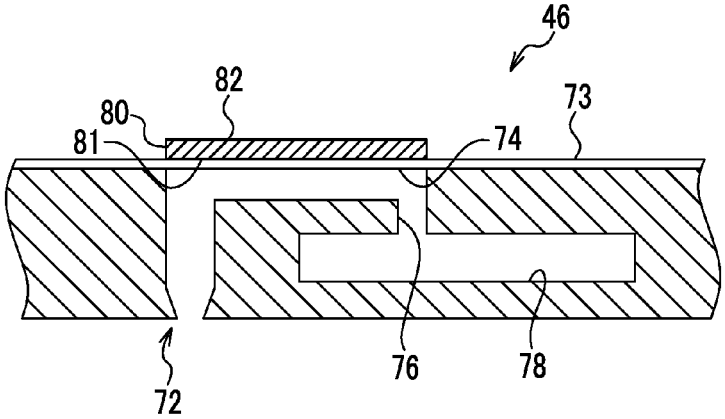
FIG. 3 is an exemplary cross-sectional view taken along the line A-A of FIG. 2.

As shown in FIG. 3, the nozzle 72 is connected to a pressure chamber 74. An ink droplet supply path 76 is formed at the end of the pressure chamber 74. The ink droplets which are supplied from an ink droplet tank (not shown) to a common flow path 78 flow into the pressure chamber 74 through the ink droplet supply path 76.

The upper side of the pressure chamber 74 is closed by a diaphragm 73 and a piezoelectric element 80 is attached to the diaphragm 73. A common electrode 81 is provided on the lower surface of the piezoelectric element 80 and an individual electrode 82 is provided on the upper surface of the piezoelectric element 80. When a voltage is applied between the common electrode 81 and the individual electrode 82, the piezoelectric element 80 is deformed and the diaphragm 73 is bent to contract the pressure chamber 74. Then, the volume of the pressure chamber 74 is reduced and the ink droplets in the pressure chamber 74 are pushed out from the nozzle 72 and then discharged. After the ink droplets are discharged, the application of the voltage to the individual electrode 82 is released. Then, the diaphragm 73 returns to the original shape and the ink droplets are supplied from the common flow path 78 to the pressure chamber 74.

As shown in FIG. 1, when the sheet P is transported to the image forming region immediately below the ink jet recording heads 46, the ink droplets are discharged from the nozzles 72 of each of the ink jet recording heads 46C, 46M, 46Y, and 46K to the image forming region of the sheet P onto which the processing liquid has been applied, on the basis of image data.

An example of a process of discharging the ink droplets from all of the nozzles 72 to the sheet P to form an image will be described with reference to FIG. 2. When the leading end of the image forming region of the sheet P is transported to a position immediately below the first nozzle row of the ink jet recording head 46, the ink droplets are discharged from the first nozzle row. Then, at the time the sheet P is transported a distance corresponding to one row in the transport direction, the ink droplets are discharged from the first and second nozzle rows. Therefore, the ink droplets discharged from the first and second nozzle rows are landed at the leading end of the image forming region of the sheet P. That is, the ink droplets discharged from the nozzles 72 with the addresses A1, A2, B1, B2, . . . which are arranged in this order from the end in the width direction of the sheet P are landed in the width direction of the sheet P. Similarly, whenever the sheet P is transported a distance corresponding to one row, the ink droplets are discharged. When the ink droplets are discharged from the sixth nozzle rows to the leading end of the image forming region of the sheet P, they are discharged at pitches L in the width direction of the sheet P. In this way, an image is formed. The ink droplets landed on the sheet P react with the processing liquid and the color material in the ink droplets is coagulated to prevent blurring.

The sheet P on which the image is formed by the above-mentioned process is transported to the dry unit 18 through the transport drum 48. The dry unit 18 includes a dry drum 50, holds the sheet P transported to the transport drum 48, and transports the sheet P in the direction of an arrow shown in FIG. 1. In addition, a heater 50A is attached to the inside of the dry drum 50 and two warm air generating devices 50B are provided outside the dry drum 50 along the outer circumferential surface of the dry drum 50.

The sheet P held by the dry drum 50 is heated by the heater 50A and is dried by warm air which is blown from the warm air generating device 50B to the sheet P. In addition, other heating members may be used instead of the heater 50A and a device which dries the sheet using radiation heat, such as a halogen heater, may be used as the warm air generating device 50B. The temperature of the heater 50A and the warm air generating device 50B may be appropriately changed depending on the type of ink droplets used or the type of sheet P used.

The sheet P dried by the dry unit 18 is transported to the fixing unit 20 through a transport drum 52. The fixing unit 20 includes a fixing drum 54, holds the sheet P transported to the transport drum 52, and transports the sheet P in the direction of an arrow shown in FIG. 1. The fixing unit 20 includes a first fixing roller 56, a second fixing roller 58, and a line sensor 60 serving as a detecting unit which are provided in this order from the downstream side in the transport direction of the sheet P.

The first fixing roller 56 and the second fixing roller 58 come into contact with the fixing drum 54 and are heated by a heating unit (not shown). The temperature of the first fixing roller 56 is set to be lower than that of the second fixing roller 58. When the sheet P held by the fixing drum 54 passes between the first and second fixing rollers 56 and 58 and the fixing drum 54, it is heated by the first fixing roller 56 and the second fixing roller 58 and comes into pressure contact with the fixing drum 54. In this way, a fixing process is performed.

The sheet P fixed by the first fixing roller 56 and the second fixing roller 58 is transported below the line sensor 60. The line sensor 60 is provided so as to face the fixing drum 54 and includes a CCD image sensor (not shown) which is provided in the axial direction of the fixing drum 54. The CCD image sensor includes pixels whose number is more than the number of nozzles 72. The line sensor 60 extends in a direction intersecting the transport direction of the sheet P, for example, in a direction perpendicular to the transport direction and has a length that is substantially equal to the width of the sheet P.

When the sheet P transported to the fixing drum 54 passes below the line sensor 60, the CCD image sensor (not shown) provided in the line sensor 60 detects the ink droplet rows landed in the image forming region of the sheet P one by one in the transport direction of the sheet P and detects the defective discharge of the nozzles 72. The 'defective discharge' includes the deviation of the landing position of the ink droplets or an abnormality of the diameter of the landed ink droplets (i.e., an abnormality in the amount of ink droplets discharged).

The sheet P which has passed through the line sensor 60 is transported to the sheet discharge unit 22. The sheet discharge unit 22 is provided with a discharge roller 62 and sends the sheet P transported to the fixing drum 54 to a discharge belt 64. The sheet P on the discharge belt 64 is discharged to a discharge tray 66.

In the ink jet recording apparatus 10 according to this embodiment, the line sensor 60 detects the liquid droplet rows of the image which is related to a print job and is formed on the sheet P one by one. However, a dedicated test pattern different from the image related to the print job may be formed and detected. In this case, since the test pattern (nozzle check pattern) which is easily detected by the CCD image sensor is formed, the detection accuracy of the defective discharge by the line sensor 60 is improved.

In the test pattern, since an arbitrary pattern can be formed, the ink droplets discharged from each nozzle 72 may be landed so as not to overlap each other in the width direction of the sheet P, the line sensor 60 may detect the landed ink droplets, and the type of the discharge failure of the nozzle 72 may be determined. For example, when the landed ink droplet deviates from the line of the test pattern in the width direction of the sheet P, such ink droplet is detected and the nozzle 72 which has discharged such ink droplet is determined to be a nozzle in a defective discharge state, which causes the deviation of the landing position. In addition, when the diameter of the landed ink droplet is beyond a predetermined range and the ink droplets which are adjacent to each other in the width direction of the sheet P overlap each other, such ink droplets are detected and the nozzles 72 which have discharged the ink droplets are determined to be the nozzles in a defective discharge state, which cause an abnormality in the diameter of the landed liquid droplet.

The ink droplets may be directly discharged onto the image forming drum 42 to form the test pattern and a line sensor with the same structure as the line sensor 60 may be used to detect the test pattern. In this case, the line sensor is provided on the downstream side of the ink jet recording head 46 in the transport direction along the outer circumference of the image forming drum 42 and detects the test pattern on the image forming drum 42. Therefore, it is possible to detect the defective discharge of the nozzle 72, without using the sheet P. In addition, a separate cleaning member may be provided along the outer circumference of the image forming drum 42 and scrape off the test pattern formed on the image forming drum 42.

The ink jet recording head 46 and the line sensor 60 are connected to a system control unit 11.

<System Control Unit>

Figure 4:
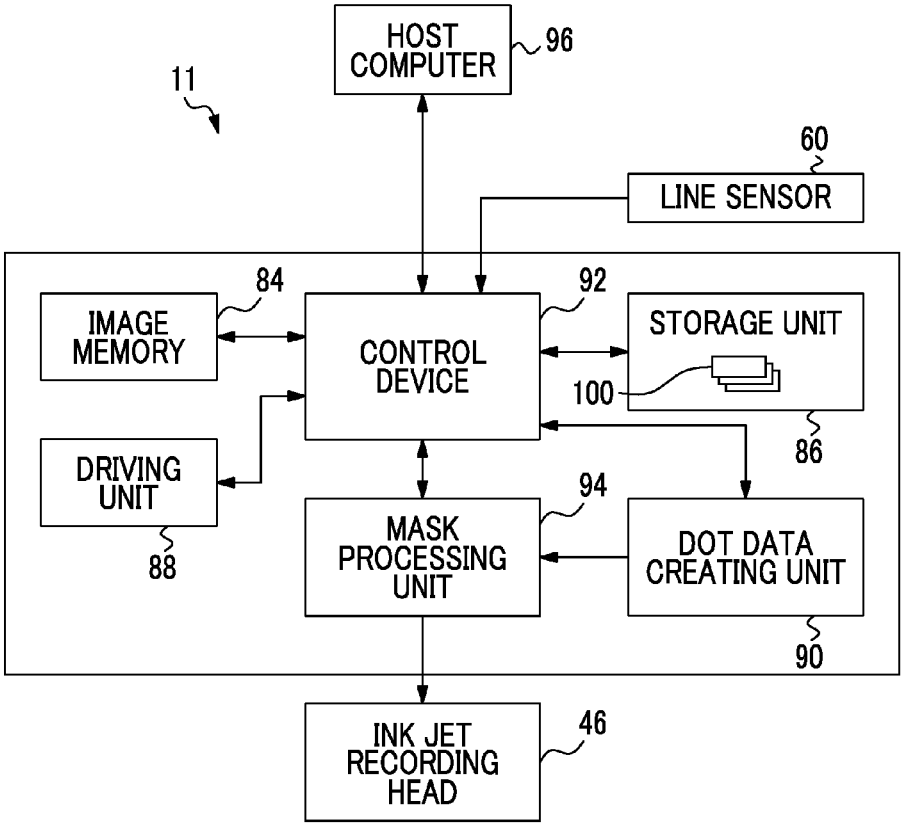
FIG. 4 is an exemplary block diagram illustrating a system control unit of the ink jet recording apparatus according to the first embodiment.

Next, the system control unit 11 of the ink jet recording apparatus 10 according to this embodiment will be described. As shown in FIG. 4, the system control unit 11 includes a storage unit 86, a driving unit 88, an image memory 84, a dot data creating unit 90, a control device 92, and a mask processing unit 94. A host computer 96, the line sensor 60, and the ink jet recording heads 46 are connected to the system control unit 11.

The dot data creating unit 90 makes a dot pattern for reproducing the image data related to the print job on the basis of the image data. The dot data creating unit 90 creates dot data including the shade or color of the image. That is, in a region in which the image is dark, the dot data is created such that the diameter of the landed ink droplet increases. On the other hand, in a region in which the image is light, the dot data is created such that the diameter of the landed ink droplet is reduced. When the diameter of the landed ink droplet increases, the amount of ink droplets discharged increases. When the diameter of the landed ink droplet is reduced, the amount of ink droplets discharged is reduced.

The driving unit 88 drives motors for rotating, for example, the transport drums 40, 48, and 52, the sheet feed drum 26, and the discharge roller 62 in response to commands from the control device 92. The image memory 84 temporarily stores the image data related to the print job or temporarily stores the calculation result of, for example, an arithmetic processing unit of the control device 92.

A table 100 is stored in the storage unit 86 in advance.

FIG. 5 is a diagram illustrating the table 100 stored in the storage unit 86.

Serial number i and the address are stored in the table 100 in advance. In addition, the amount of deviation $\Delta_{(i)}$ of the landing position is described for each serial number i in the table 100 by a registration process of the control device 92, which will be described below. The unit of the amount of deviation $\Delta_{(i)}$ of the landing position in FIG. 5 is micrometer (μm).

Figure 6A:
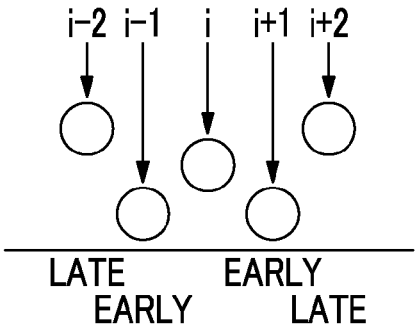
FIGS. 6A to 6C are exemplary schematic diagrams illustrating the discharge order of two nozzles on either side of a nozzle with serial number i and nozzles which are adjacent to the outside of the two nozzles on either side.

In addition, information indicating whether nozzles (nozzles with serial numbers i−1 and i+1) on either side of the nozzle with serial number i discharge the ink droplets earlier than nozzles (nozzles with serial numbers i−2 and i+2) which are adjacent to the outside of the two nozzles with serial numbers i−2 and i+2 (see FIG. 6A) is described for each serial number i in the table 100. In FIG. 5, when the two nozzles with serial numbers i−2 and i+2 discharge the ink droplets earlier than the nozzles with serial numbers i−2 and i+2, they are represented by ○. Otherwise, they are represented by a blank. Hereinafter, the nozzle with serial number i is represented by $\mathbf{72}_{(i)}$, the nozzle with serial number i−1 is represented by $\mathbf{72}_{(i-1)}$, the nozzle with serial number i+1 is represented by $\mathbf{72}_{(i+1)}$, the nozzle with serial number i−2 is represented by $\mathbf{72}_{(i-2)}$, and the nozzle with serial number i+2 is represented by $\mathbf{72}_{(i+2)}$.

Figure 6B:
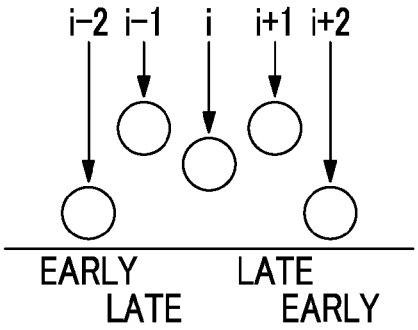

Furthermore, information indicating whether one of the nozzles $\mathbf{72}_{(i-1)}$ and $\mathbf{72}_{(i+1)}$ on either side of the nozzle $\mathbf{72}_{(i)}$ discharges the ink droplets earlier than the nozzles $\mathbf{72}_{(i-2)}$ and $\mathbf{72}_{(i+2)}$ which are adjacent to the outside of the two nozzles $\mathbf{72}_{(i-1)}$ and $\mathbf{72}_{(i+1)}$ and the other of the two nozzles $\mathbf{72}_{(i-1)}$ and $\mathbf{72}_{(i+1)}$ discharges the ink droplets later than the nozzles $\mathbf{72}_{(i-2)}$ and $\mathbf{72}_{(i+2)}$ which are adjacent to the outside of the two nozzles $\mathbf{72}_{(i-1)}$ and $\mathbf{72}_{(i+1)}$ (see FIG. 6B) is described for each serial number i in the table 100 in advance. That is, information indicating whether the two nozzles $\mathbf{72}_{(i-1)}$ and $\mathbf{72}_{(i+1)}$ have different discharge orders is described in the table 100. In FIG. 5, when the two nozzles $\mathbf{72}_{(i-1)}$ and $\mathbf{72}_{(i+1)}$ have different discharge orders, they are represented by ○. Otherwise, the nozzles are represented by a blank.

Figure 6C:
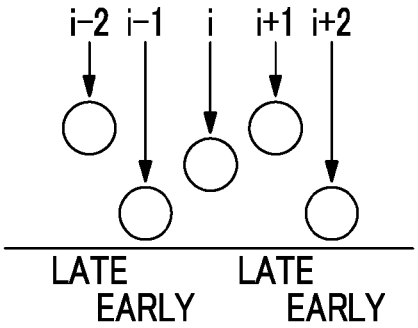

In addition, information indicating whether the nozzles $\mathbf{72}_{(i-1)}$ and $\mathbf{72}_{(i+1)}$ on either side of the nozzle $\mathbf{72}_{(i)}$ discharge the ink droplets later than the nozzles $\mathbf{72}_{(i-2)}$ and $\mathbf{72}_{(i+2)}$ which are adjacent to the outside the two nozzles $\mathbf{72}_{(i-1)}$ and $\mathbf{72}_{(i+1)}$ (see FIG. 6C) is described for each serial number i in the table 100 in advance. In FIG. 5, when the two nozzles $\mathbf{72}_{(i-1)}$ and $\mathbf{72}_{(i+1)}$ both discharge the ink droplets later than the nozzles $\mathbf{72}_{(i-2)}$ and $\mathbf{72}_{(i+2)}$, they are represented by ○. Otherwise, the nozzles are represented by a blank.

When the nozzle $\mathbf{72}_{(i)}$ with serial number i does not discharge the ink droplets, the two nozzles $\mathbf{72}_{(i-1)}$ and $\mathbf{72}_{(i+1)}$ on either side of the nozzle $\mathbf{72}_{(i)}$ complement the image defect.

Returning to FIG. 4, the control device 92 is an arithmetic processing unit, such as a CPU, and controls the overall operation of the ink jet recording apparatus 10. Specifically, the control device 92 controls the driving of the driving unit 88, or it reads arbitrary image data from the image memory 84 and instructs the dot data creating unit 90 to create dot data.

The control device 92 stores data for the discharge failure of each nozzle 72 detected by the line sensor 60 in the storage unit 86. In this embodiment, the control device 92 serving as an example of a quantification unit particularly quantifies the degree of deviation of the landing position for each nozzle 72 and registers the value (the amount of deviation $\Delta_{(i)}$ of the landing position) in the table 100.

When the amount of deviation $\Delta_{(i)}$ of the landing position corresponding to the nozzle 72 which causes the deviation of the landing position is greater than a discharge disable threshold value $\Delta_t$, the control device 92 serving as an example of a discharge disabling unit disables the discharge operation of the nozzle 72 causing the positional deviation in advance (prevents the discharge of the ink droplets from the nozzle 72) before printing starts, and prevents the deviation of the landing position while the print job is being printed. In addition, the control device 92 serving as an example of a threshold value change unit changes the discharge disable threshold value $\Delta_t$ depending on the discharge order of two nozzles $\mathbf{72}_{(i-1)}$ and $\mathbf{72}_{(i+1)}$ on either side of the nozzle $\mathbf{72}_{(i)}$ causing the deviation of the landing position and the nozzles $\mathbf{72}_{(i-2)}$ and $\mathbf{72}_{(i+2)}$, which are adjacent to the outside of the two nozzles $\mathbf{72}_{(i-1)}$ and $\mathbf{72}_{(i+1)}$ before the above-mentioned determination process.

The mask processing unit 94 serving as an example of a complementary unit receives the address of the nozzle 72 whose discharge operation is to be disabled by the control device 92 and edits the dot data created by the dot data creating unit 90. For example, the mask processing unit 94 edits the dot data such that the dot data corresponding to the discharge-disabled nozzle 72 is deleted and the diameter of the landed liquid droplets discharged from two nozzles $\mathbf{72}_{(i-1)}$ and $\mathbf{72}_{(i+1)}$ on either side of the discharge-disabled nozzle $\mathbf{72}_{(i)}$ increases.

—Operation—

Next, the operation of the ink jet recording apparatus 10 according to the first embodiment of the invention will be described.

Figure 7:
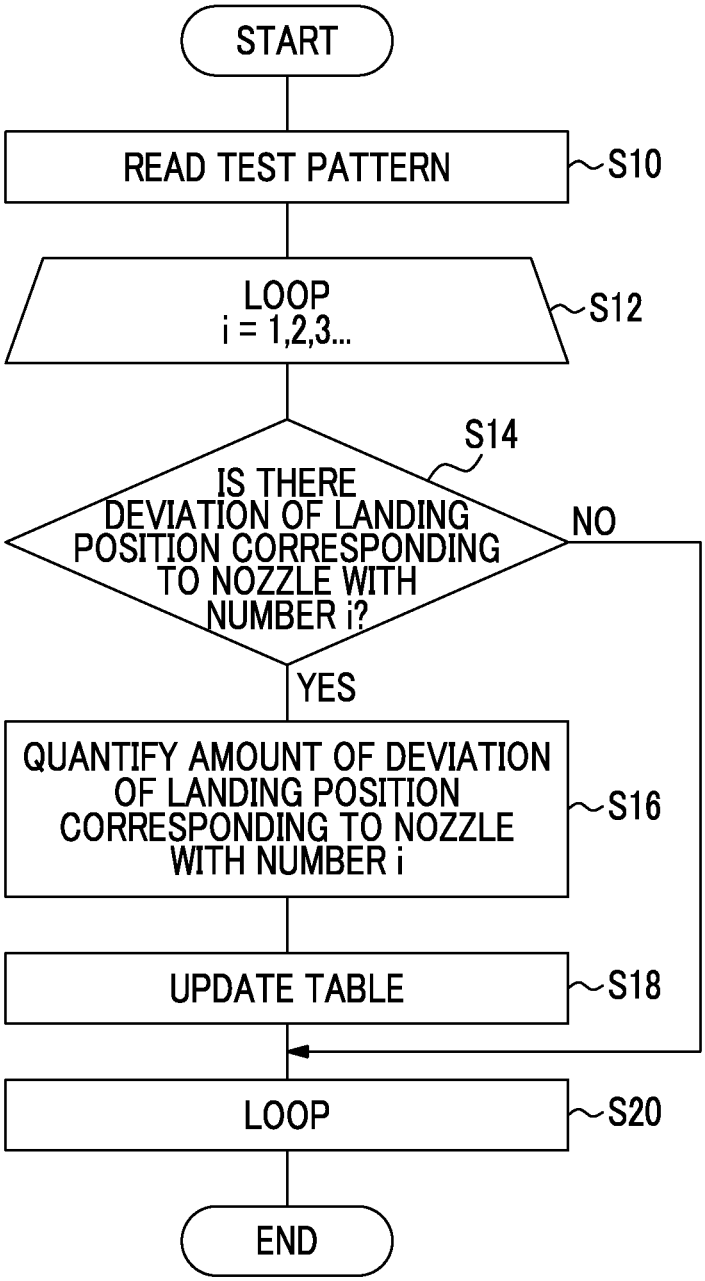
FIG. 7 is an exemplary flowchart illustrating the procedure of the process of a control device registering the amount of deviation of a landing position.

FIG. 7 is a flowchart illustrating the procedure of the process of the control device 92 registering the amount of deviation of the landing position. In the following description, words in parentheses indicate a step identification number in FIG. 7.

(S10) The control device 92 instructs each CCD image sensor to read the test pattern on the sheet P which is transported immediately below the line sensor 60 and proceeds to Step S12.

(S12 and S20) The control device 92 repeatedly perform Steps S14 to S18 for the nozzles 72 with serial numbers 1 to i.

(S14) The control device 92 detects (determines) whether the deviation of the landing position occurs in the nozzle $\mathbf{72}_{(i)}$ with serial number i on the basis of the test pattern acquired from the line sensor 60. When the determination result is 'Yes', the control device 92 proceeds to Step S16. On the other hand, when the determination result is 'No', the control device 92 proceeds to Step S20. That is, the control device 92 adds 1 to serial number i and proceeds to Step S14. When the nozzle $72_{(i)}$ with serial number i is the last nozzle, the control device 92 ends the process.

(S16) The control device 92 quantifies the degree of deviation of the landing position corresponding to the nozzle $72_{(i)}$ (the amount of deviation $\Delta_{(i)}$ of the landing position) and proceeds to Step S18.

(S18) The control device 92 registers the quantified amount of deviation $\Delta_{(i)}$ of the landing position in the corresponding field of the table 100 and proceeds to Step S20. That is, the control device 92 adds 1 to serial number i and proceeds to Step S14. When the nozzle $72_{(i)}$ with serial number i is the last nozzle, the control device 92 ends the process.

The amount of deviation $\Delta_{(i)}$ of the landing position corresponding to each nozzle $72_{(i)}$ is registered in the table 100 as shown in FIG. 5 by the above-described process.

The control device 92 of the ink jet recording apparatus 10 according to this embodiment performs the following printing process when a print job is input from the host computer 96.

Figure 8:
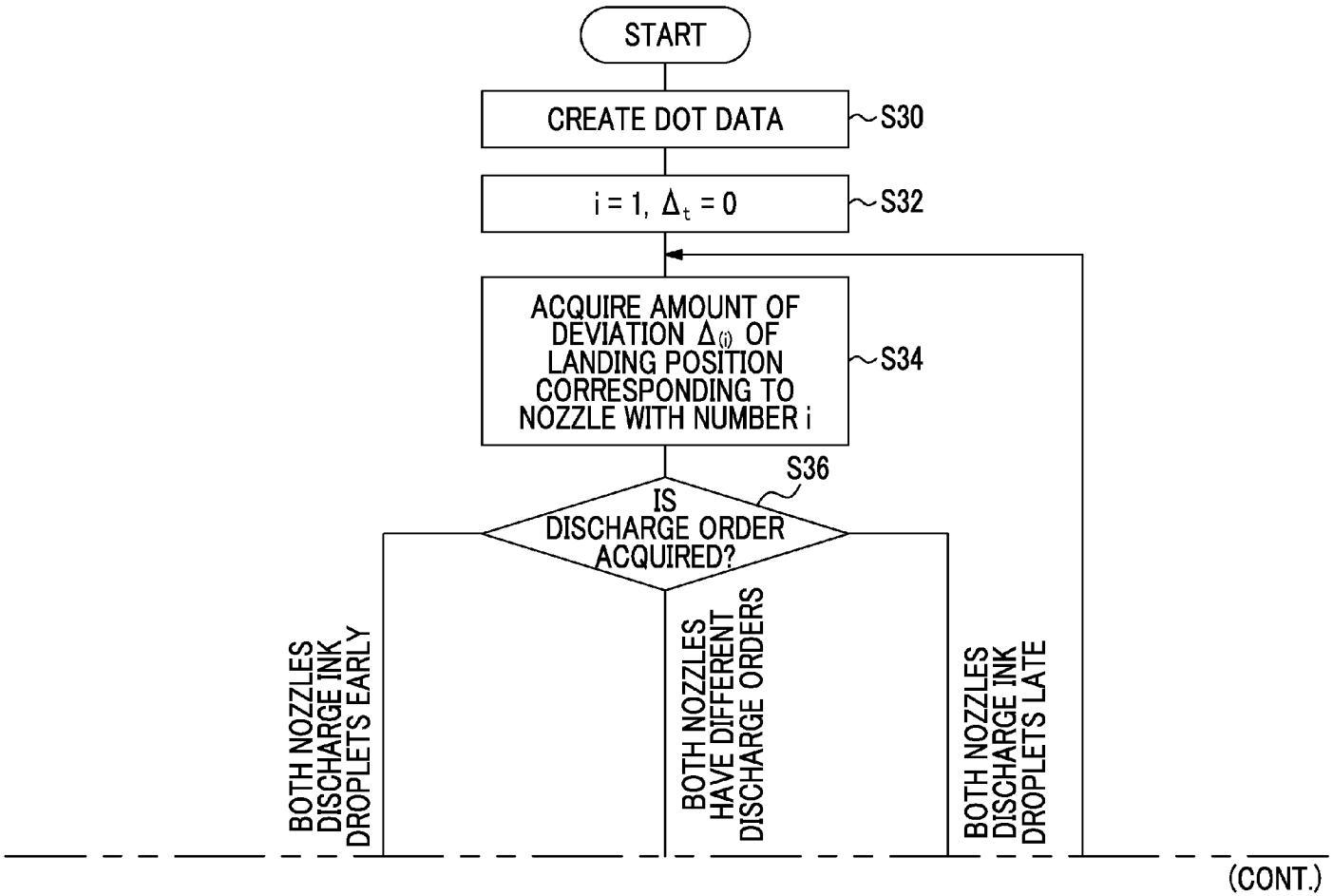
FIG. 8 is an exemplary flowchart illustrating the procedure of a printing process performed by the control device.

FIG. 8 is a flowchart illustrating the procedure of the printing process performed by the control device 92. In the following description, words in parentheses indicate a step identification number in FIG. 8.

(S30) The control device 92 temporarily stores the image data which is related to the print job received from the host computer 96 in the image memory 84 and instructs the dot data creating unit 90 to create dot data. Alternatively, the control device 92 directly instructs the dot data creating unit 90 to create dot data, without storing the image data in the image memory 84. Then, the control device 92 proceeds to Step S32.

(S32) The control device 92 substitutes 1 into a variable i and substitutes 0 into a variable $\Delta_t$ which is the discharge disable threshold value. Then, the control device 92 proceeds to Step S34.

(S34) The control device 92 controls the storage unit 86 such that the amount of deviation $\Delta_{(i)}$ of the landing position corresponding to the nozzle $72_{(i)}$ with serial number i is acquired from the table 100 and proceeds to Step S36.

(S36) The control device 92 controls the storage unit 86 so as to acquire the discharge order corresponding to the nozzle $72_{(i)}$ with serial number i from the table 100. As described above, the discharge order herein indicates the discharge order between the nozzles $72_{(i-1)}$ and $72_{(i+1)}$ on either side of the nozzle $72_{(i)}$, and the nozzles $72_{(i-2)}$ and $72_{(i+2)}$ which are adjacent to the outside of the two nozzles $72_{(i-1)}$ and $72_{(i+1)}$.

Then, the control device 92 proceeds to Step S38 when the nozzles $72_{(i-1)}$ and $72_{(i+1)}$ on either side of the nozzle $72_{(i)}$ both discharge the ink droplets earlier than the nozzles $72_{(i-2)}$ and $72_{(i+2)}$ which are adjacent to the outside of the two nozzles $72_{(i-1)}$ and $72_{(i+1)}$ in the acquired discharge order.

In addition, the control device 92 proceeds to Step S40 when one of the nozzles $72_{(i-1)}$ and $72_{(i+1)}$ on either side of the nozzle $72_{(i)}$ discharges the ink droplets earlier than one of the nozzles $72_{(i-2)}$ and $72_{(i+2)}$ which is adjacent to the outside of the one of the two nozzles $72_{(i-1)}$ and $72_{(i+1)}$ and the other one of the nozzles $72_{(i-1)}$ and $72_{(i+1)}$ discharges the ink droplets later than the one of the nozzles $72_{(i-2)}$ and $72_{(i+2)}$ which is adjacent to the outside of the other one of the two nozzles $72_{(i-1)}$ and $72_{(i+1)}$ in the acquired discharge order. That is, when the two nozzles $72_{(i-1)}$ and $72_{(i+1)}$ have different discharge orders, the control device 92 proceeds to Step S40. In addition, the control device 92 proceeds to Step S42 when the nozzles $72_{(i-1)}$ and $72_{(i+1)}$ on either side of the nozzle $72_{(i)}$ both discharge the ink droplets later than the nozzles $72_{(i-2)}$ and $72_{(i+2)}$ which are adjacent to the outside of the two nozzles $72_{(i-1)}$ and $72_{(i+1)}$ in the acquired discharge order.

(S38) The control device 92 substitutes a value 'a' into the discharge disable threshold value $\Delta_t$ and proceeds to Step S44. That is, in Step S38, the discharge disable threshold value $\Delta_t$=0 is changed to the discharge disable threshold value $\Delta_t$=a corresponding to the discharge order.

(S40) The control device 92 substitutes a value 'b' (a<b) into the discharge disable threshold value $\Delta_t$ and proceeds to Step S44. That is, in Step S40, the discharge disable threshold value $\Delta_t$=0 is changed to the discharge disable threshold value $\Delta_t$=b corresponding to the discharge order.

(S42) The control device 92 substitutes a value c (a<b<c) into the discharge disable threshold value $\Delta_t$ and proceeds to Step S44. That is, in Step S42, the discharge disable threshold value $\Delta_t$=0 is changed to the discharge disable threshold value $\Delta_t$=c corresponding to the discharge order.

(S44) The control device 92 determines whether the amount of deviation $\Delta_{(i)}$ of the landing position of the ink droplet discharged from the nozzle $72_{(i)}$ with serial number i is greater than the discharge disable threshold value $\Delta_t$. When the determination result is 'Yes', that is, when $\Delta_{(i)}>\Delta_t$ is satisfied, the control device 92 proceeds to Step S46. When the determination result is 'No', that is, when $\Delta_{(i)}$ $\Delta_t$ is satisfied, the control device 92 proceeds to Step S48.

(S46) The control device 92 registers the nozzle $72_{(i)}$ with serial number i as the discharge-disabled nozzle.

(S48) The control device 92 determines whether the nozzle $72_{(i)}$ with serial number i is the last nozzle 72. When the determination result is 'Yes', the control device 92 proceeds to Step S52. When the determination result is 'No', the control device 92 proceeds to Step S50.

(S50) The control device 92 adds 1 to the variable i and returns to Step S34.

(S52) The control device 92 determines whether to perform the process of disabling the discharge operation of the nozzle for all of the nozzles $72_{(i)}$ in this way, edits the dot data through the mask processing unit 94, and proceeds to Step S54. Specifically, when the nozzle with serial number 6 is registered as the discharge-disabled nozzle, the control device 92 deletes the dot data corresponding to the nozzle $72_{(6)}$ and edits the dot data such that the amount of ink droplets discharged from the nozzle $72_{(5)}$ and the nozzle $72_{(7)}$ on either side of the nozzle $72_{(6)}$ with serial number 6 increases.

Figure 9A:
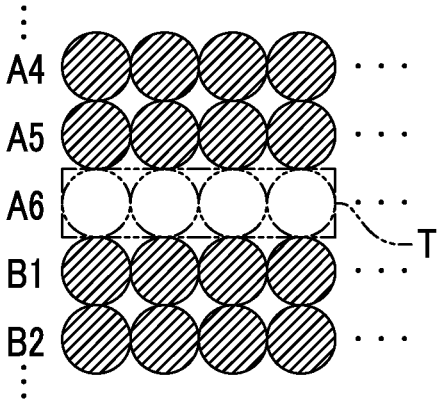
FIGS. 9A and 9B are exemplary schematic diagrams illustrating a complementary process for a discharge-disabled nozzle.
Figure 9B:
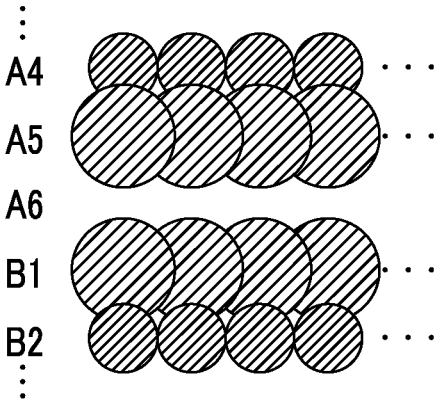

When the dot data is edited in this way, as shown in FIG. 9A, the deletion of the dot data corresponding to the nozzle $72_{(6)}$ with serial number 6, that is, the address A6 causes the ink droplets not to be discharged to a region T to which the nozzle $72_{(6)}$ is scheduled to discharge the ink droplets and thereby the region T is conspicuous. However, as shown in FIG. 9B, the amount of ink droplets discharged from the nozzles $72_{(5)}$ and $72_{(7)}$ with the addresses A5 and B1, that is, serial numbers 5 and 7 which are provided on either side of the nozzle $72_{(6)}$ increases, and thereby the diameter of the ink droplets landed increases and the region T is covered with the ink droplets. In FIG. 9A, for convenience of explanation, the ink droplets discharged from each nozzle 72 are arranged so as not to overlap each other. However, in practice, the ink droplets overlap each other.

(S54) The control device 92 starts printing. The ink droplets are discharged to the sheet P on the basis of the dot data edited in Step S52 to form an image. As described above, before the printing of the print job starts, the discharge operation of the nozzle $72_{(i)}$ is disabled and the complement of the ink droplets by the nozzles $72_{(i-1)}$ and $72_{(i+1)}$ on either side of the nozzle $72_{(i)}$ is set. Therefore, it is possible to disable the discharge operation of the nozzle $72_{(i)}$ during a print job and thus prevent the occurrence of a printing failure.

Next, a reference example of the first embodiment will be described.

In the reference example, when the liquid droplets are discharged from the nozzle $72_{(i)}$ causing the deviation of the landing position, an image defect occurs. When the amount of deviation $\Delta_{(i)}$ of the landing position is greater than a fixed threshold value, the discharge operation of the nozzle $72_{(i)}$ is uniformly disabled and the nozzles $72_{(i-1)}$ and $72_{(i+1)}$ on either side of the nozzle $72_{(i)}$ complement the image defect.

However, since the complementary process is performed after the discharge operation of the nozzles in the defective discharge state are uniformly disabled, the number of nozzles which complement the image defect increases and the load of the complementary process increases. For example, when the image defect is complemented by the nozzles $72_{(i-1)}$ and $72_{(i+1)}$ on either side of the discharge-disabled nozzle $72_{(i)}$ and other discharge-disabled nozzles are near the nozzles $72_{(i-1)}$ and $72_{(i+1)}$, the amount of ink droplets discharged from the adjacent nozzles $72_{(i-1)}$ and $72_{(i+1)}$ increases and the load of the complementary process increases. This load caused by the complementary process of adjacent nozzles may be reduced by cancelling the discharge-disabled state of some nozzles.

In such case, a white line may appear in the image to be formed.

In contrast, in the first embodiment of the invention, in Steps S36 to S42 shown in FIG. 8, the control device 92 changes the discharge disable threshold value $\Delta_{(i)}$ depending on the discharge order of the nozzles $72_{(i-1)}$ and $72_{(i+1)}$ which are provided on either side of the nozzle $72_{(i)}$ with serial number i and complement the image defect and the nozzles $72_{(i-2)}$ and $72_{(i+2)}$ which are adjacent to the outside of the nozzles $72_{(i-1)}$ and $72_{(i+1)}$.

Therefore, it is possible to reduce the number of discharge-disabled nozzles, as compared to the case in which the control device 92 uniformly disables the discharge operation of the nozzles causing the deviation of the landing position using the fixed discharge disable threshold value. As a result, it is possible to reduce the load of the complementary process and prevent the generation of white lines when there is a nozzle causing the deviation of the landing position.

In particular, the possibility of the white lines being generated through the mask processing unit 94 depends on the discharge order of the nozzles $72_{(i-1)}$ and $72_{(i+1)}$ which are on either side of the discharge-disabled nozzle $72_{(i)}$ and complement the image defect and the nozzles $72_{(i-2)}$ and $72_{(i+2)}$ which are adjacent to the outside of the nozzles $72_{(i-1)}$ and $72_{(i+1)}$.

Figure 10A:
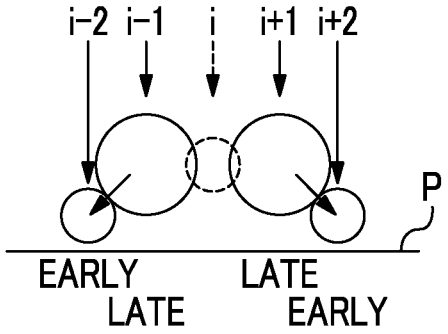
FIGS. 10A and 10B are exemplary schematic diagrams illustrating the discharge order of two nozzles on either side of a discharge-disabled nozzle with serial number i and nozzles which are adjacent to the outside of the two nozzles on either side of the discharge-disabled nozzle with serial number i.

Specifically, as shown in FIG. 10A, when the nozzles $72_{(i-1)}$ and $72_{(i+1)}$ which complement the image defect both discharge the ink droplets later than the nozzles $72_{(i-2)}$ and $72_{(i+2)}$ which are adjacent to the outside of the nozzles $72_{(i-1)}$ and $72_{(i+1)}$, the ink droplets which are discharged later are coagulated with the ink droplets which are discharged earlier from the nozzles $72_{(i-2)}$ and $72_{(i+2)}$. This coagulation action (landing interference) causes the landing position of the ink droplets discharged from the nozzles $72_{(i-1)}$ and $72_{(i+1)}$ which complement the image defect to be extended. Therefore, even after the complementary process is performed, a white line is likely to be formed.

Figure 10B:
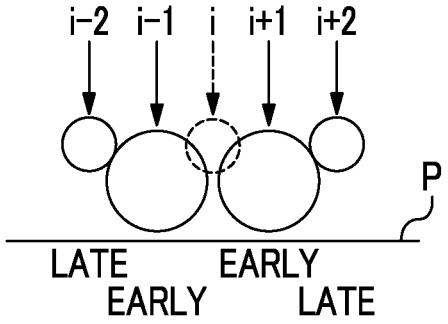

In contrast, as shown in FIG. 10B, when the nozzles $72_{(i-1)}$ and $72_{(i+1)}$ which complement the image defect both discharge the ink droplets earlier than the nozzles $72_{(i-2)}$ and $72_{(i+2)}$ which are adjacent to the outside of the nozzles $72_{(i-1)}$ and $72_{(i+1)}$, the ink droplets which are discharged earlier are landed on the sheet P and are less likely to be coagulated with the ink droplets which are discharged later from the nozzles $72_{(i-2)}$ and $72_{(i+2)}$. As a result, a white line is less likely to be formed after the complementary process.

The theory and examination result of the inventors proved that, when the nozzles $72_{(i-1)}$ and $72_{(i+1)}$ which complemented the image defect both discharged the ink droplets later than the nozzles $72_{(i-2)}$ and $72_{(i+2)}$ which were adjacent to the outside of the nozzles $72_{(i-1)}$ and $72_{(i+1)}$, the number of white lines formed was (for example, about two times) more than that when the nozzles $72_{(i-1)}$ and $72_{(i+1)}$ both discharged the ink droplets earlier than the nozzles $72_{(i-2)}$ and $72_{(i+2)}$.

It is considered that, when one of the nozzles $72_{(i-1)}$ and $72_{(i+1)}$ which complement the image defect discharges the ink droplets earlier than one of the nozzles $72_{(i-2)}$ and $72_{(i+2)}$ which are adjacent to the outside of the one of the nozzles $72_{(i-1)}$ and $72_{(i+1)}$ and the other one of the nozzles $72_{(i-1)}$ and $72_{(i+1)}$ discharges the ink droplets later than the other one of nozzles $72_{(i-2)}$ and $72_{(i+2)}$, the number of white lines formed is more than that when the nozzles $72_{(i-1)}$ and $72_{(i+1)}$ both discharge the ink droplets earlier than the nozzles $72_{(i-2)}$ and $72_{(i+2)}$. In addition, it is considered that, when one of the nozzles $72_{(i-1)}$ and $72_{(i+1)}$ which complement the image defect discharges the ink droplets earlier than one of the nozzles $72_{(i-2)}$ and $72_{(i+2)}$ and the other of the nozzles $72_{(i-1)}$ and $72_{(i+1)}$ discharges the ink droplets later than the other one of the nozzles $72_{(i-2)}$ and $72_{(i+2)}$, the number of white lines formed is less than that when the nozzles $72_{(i-1)}$ and $72_{(i+1)}$ both discharge the ink droplets later than the nozzles $72_{(i-2)}$ and $72_{(i+2)}$.

In the first embodiment, in Steps S36 to S42 shown in FIG. 8, when the nozzles $72_{(i-1)}$ and $72_{(i+1)}$ both discharge the ink droplets later than the nozzles $72_{(i-2)}$ and $72_{(i+2)}$, that is, in the case of the discharge order which is considered to generate a large number of white lines, the control device 92 changes the discharge disable threshold value $\Delta_{(i)}$ to the discharge disable threshold value $\Delta_{(i)}$=c which is greater than the discharge disable threshold value $\Delta_{(i)}$=a set when the nozzles $72_{(i-1)}$ and $72_{(i+1)}$ both discharge the ink droplets earlier than the nozzles $72_{(i-2)}$ and $72_{(i+2)}$. Therefore, the discharge operation of the nozzle $72_{(i)}$ to which adjacent are the nozzles $72_{(i-1)}$ and $72_{(i+1)}$ which discharge the ink droplets later than the nozzles $72_{(i-2)}$ and $72_{(i+2)}$ and which causes the deviation of the landing position can be prevented from being disabled in Steps S44 to S46. When the discharge operation of the nozzle $72_{(i)}$ is not disabled, the complementary process for the nozzle $72_{(i)}$ is not performed. As a result, it is possible to reduce the number of white lines formed, as compared to when the complementary process is performed.

However, in the case the ink droplets are discharged later from the nozzles $72_{(i-1)}$ and $72_{(i+1)}$ than the nozzles $72_{(i-2)}$ and $72_{(i+2)}$ in the discharge order while the amount of deviation $\Delta_{(i)}$ of the landing position is still more than $\Delta_{(i)}$=c, it is considered that performing the complementary process is better than not performing the complementary process, in order to prevent white lines from being formed. Therefore, in this case, the complementary process is performed.

In Steps S36 to S42 shown in FIG. 8, if the nozzles $72_{(i-1)}$ and $72_{(i+1)}$ have different discharge orders, the control device 92 changes the discharge disable threshold value $\Delta_{(i)}$ to the discharge disable threshold value $\Delta_{(i)}$=b which is greater than the discharge disable threshold value $\Delta_{(i)}$=a when the nozzles $72_{(i-1)}$ and $72_{(i+1)}$ both discharge the ink droplets earlier than the nozzles $72_{(i-2)}$ and $72_{(i+2)}$, and changes the discharge disable threshold value $\Delta_{(i)}$ to the discharge disable threshold value $\Delta_{(i)}$=b which is less than the discharge disable threshold value $\Delta_{(i)}$=c when the nozzles $72_{(i-1)}$ and $72_{(i+1)}$ both discharge the ink droplets later than the nozzles $72_{(i-2)}$ and $72_{(i+2)}$.

Therefore, it is possible to prevent the discharge operation of the nozzle $72_{(i)}$ causing the deviation of the landing position from being disabled in Steps S44 to S46, when the nozzles $72_{(i-1)}$ and $72_{(i+1)}$ have different discharge orders. When the discharge operation of the nozzle $72_{(i)}$ is not disabled, the control device 92 serving as an example of the complementary unit does not perform the complementary process for the nozzle in a defective discharge state. As a result, it is possible to prevent the white lines from being formed, as compared to when the complementary process is performed.

However, in the case where the nozzles $72_{(i-1)}$ and $72_{(i+1)}$ have different discharge orders while the amount of deviation $\Delta_{(i)}$ of the landing position is still more than $\Delta_{(i)}$=b, it is considered that performing the complementary process is better than not performing the complementary process in order to prevent the generation of white lines. Therefore, in this case, the complementary process is performed.

Second Embodiment

Next, an image forming apparatus and an image forming method according to a second embodiment of the invention will be described in detail. In the drawings, members (components) with the same or corresponding functions as those in the first embodiment are denoted by the same reference numerals and the description thereof will be appropriately omitted.

The image forming apparatus according to the second embodiment of the invention has the same structure as the ink jet recording apparatus 10 according to the first embodiment. However, the image forming apparatus according to the second embodiment differs from the same structure as the ink jet recording apparatus 10 according to the first embodiment in the printing process performed by the control device 92.

Figure 11:
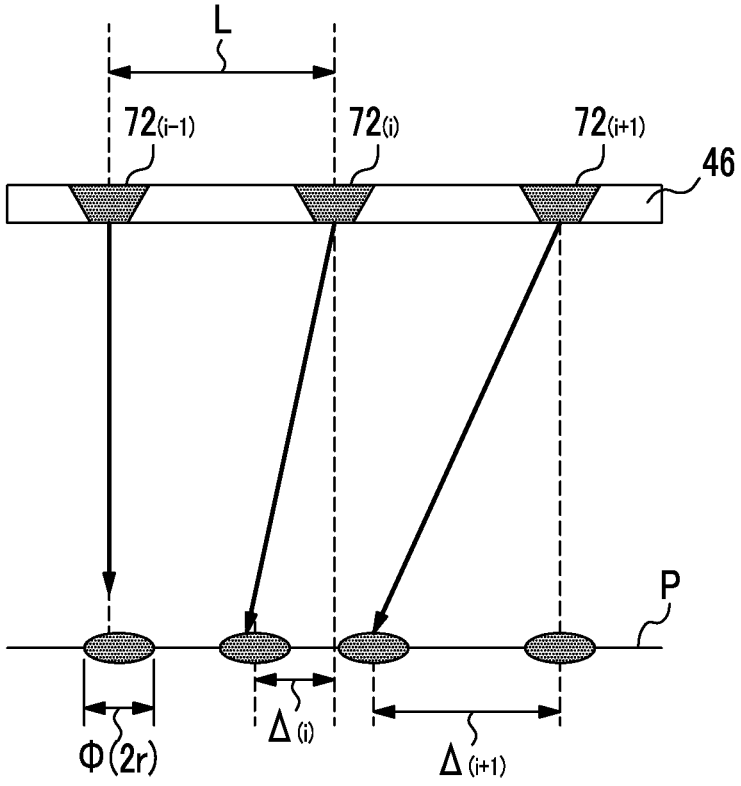
FIG. 11 is an exemplary diagram illustrating parameters used in the printing process performed by the control device.

FIG. 11 is a diagram illustrating parameters used in the printing process performed by the control device 92.

In this embodiment, it is assumed that the amount of deviation of the landing position of ink droplets discharged from a nozzle $72_{(i)}$ with serial number i is $\Delta_{(i)}$ and the amount of deviation of the landing position of ink droplets discharged from a nozzle $72_{(i+1)}$ with serial number i+1 is $\Delta_{(i+1)}$. In addition, in this embodiment, it is assumed that the dot diameter of the ink droplet (the diameter when the ink droplet is landed and spread) is $\phi(2r)$, the distance (pitch) between the nozzles is L, and the rates of increase of a discharge disable threshold value $\Delta_t$ are $\alpha$, $\beta$ and $\gamma$ ($\alpha<\beta<\gamma$; $\alpha=1$).

Figure 12:
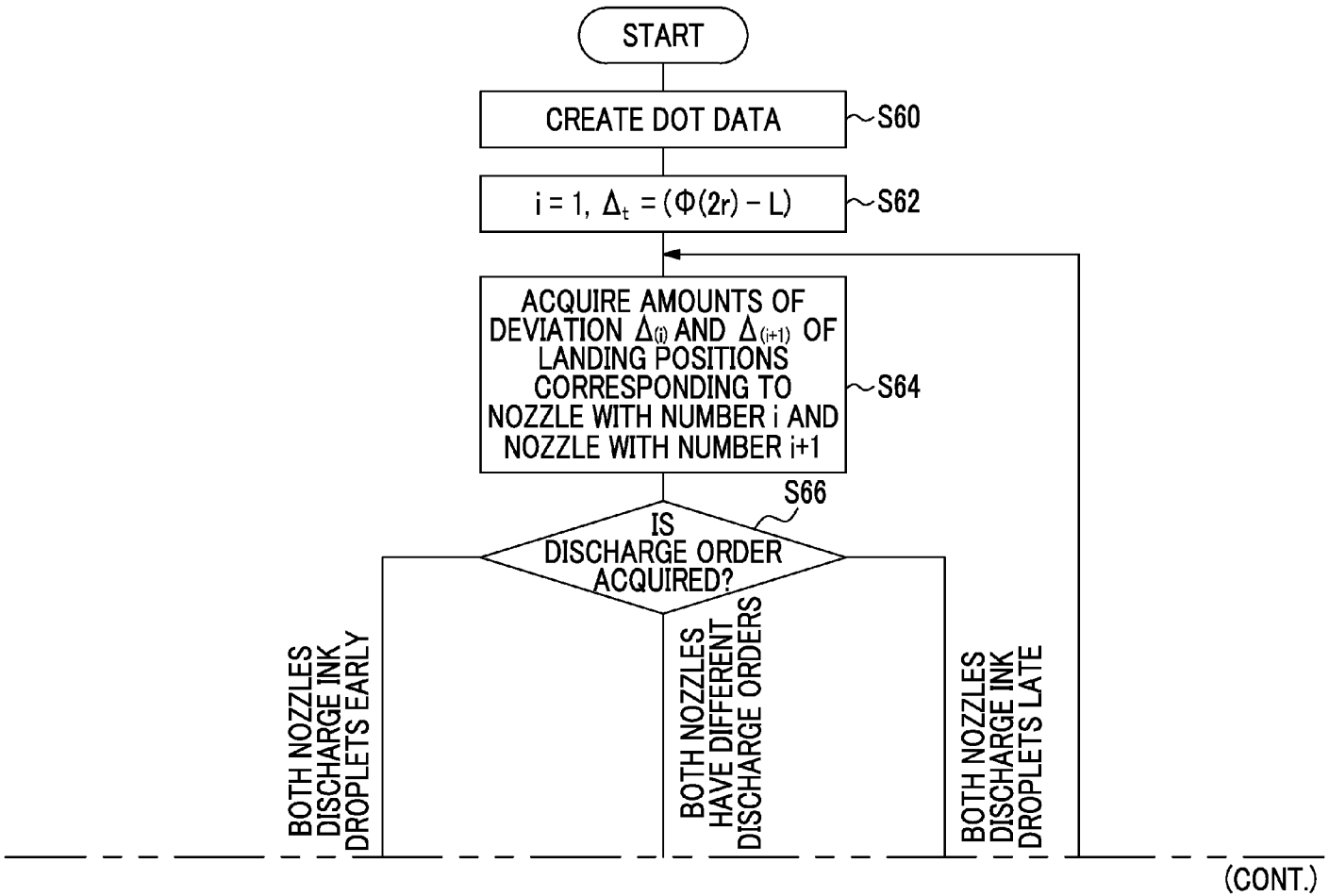
FIG. 12 is an exemplary flowchart illustrating the procedure of a printing process performed by a control device according to a second embodiment.

FIG. 12 is a flowchart illustrating the procedure of the printing process performed by the control device 92. Hereinafter, words in parentheses indicate a step identification number. The content of the process in Step S60 and Steps S76 to S84 shown in FIG. 12 is the same as that of the process in Step S30 and Steps S46 to S54 shown in FIG. 8 and thus the description thereof will be omitted.

(S62) The control device 92 substitutes 1 into a variable i and substitutes $\phi(2r)-L$ into a variable $\Delta_t$ which is a discharge disable threshold value. Then, the control device 92 proceeds to Step S64.

(S64) The control device 92 serving as an example of a quantification unit controls a storage unit 86 such that the amount of deviation $\Delta_{(i)}$ of the landing position corresponding to the nozzle 72 with serial number i which is registered in a table 100 and the amount of deviation $\Delta_{(i+1)}$ of the landing position corresponding to the nozzle 72 with serial number i+1 are acquired, and proceeds to Step S66.

(S66) The control device 92 controls the storage unit 86 such that a discharge order corresponding to the nozzle $72_{(i)}$ with serial number i is acquired from the table 100.

Then, the control device 92 proceeds to Step S68 when two nozzles $72_{(i-1)}$ and $72_{(i+1)}$ on either side of the nozzle $72_{(i)}$ both discharge the ink droplets earlier than the nozzles $72_{(i-2)}$ and $72_{(i+2)}$ which are adjacent to the outside of the nozzles $72_{(i-1)}$ and $72_{(i+1)}$ in the acquired discharge order.

In addition, the control device 92 proceeds to Step S70 when one of the two nozzles $72_{(i-1)}$ and $72_{(i+1)}$ on either side of the nozzle $72_{(i)}$ discharges the ink droplets earlier than one of the nozzles $72_{(i-2)}$ and $72_{(i+2)}$ which are adjacent to the outside of the nozzles $72_{(i-1)}$ and $72_{(i+1)}$ and the other of the two nozzles $72_{(i-1)}$ and $72_{(i+1)}$ on either side of the nozzle $72_{(i)}$ discharges the ink droplets later than the other one of the nozzles $72_{(i-2)}$ and $72_{(i+2)}$ which are adjacent to the outside of the nozzles $72_{(i-1)}$ and $72_{(i+1)}$ in the acquired discharge order. That is, when the discharge order is different in the nozzles $72_{(i-1)}$ and $72_{(i+1)}$, the control device 92 proceeds to Step S70.

The control device 92 proceeds to Step S72 when the two nozzles $72_{(i-1)}$ and $72_{(i+1)}$ on either side of the nozzle $72_{(i)}$ both discharge the ink droplets later than the nozzles $_{(i-2)}$ and $72_{(i+2)}$ which are adjacent to the outside of the nozzles $72_{(i-1)}$ and $72_{(i+1)}$ in the acquired discharge order.

(S68) The control device 92 substitutes $\alpha\times\Delta_t$ into the discharge disable threshold value $\Delta_t$ and proceeds to Step S74. That is, in Step S68, the discharge disable threshold value $\Delta_t=(\phi(2r)-L)$ is multiplied by a according to the discharge order and is changed to a discharge disable threshold value $\Delta_t=\alpha\times(\phi(2r)-L)$. However, in this embodiment, since $\alpha$ is 1, there is no substantial increase in the discharge disable threshold value.

(S70) The control device 92 substitutes $\beta\times\Delta_t$ into the discharge disable threshold value $\Delta_t$ and proceeds to Step S74. That is, in Step S70, the discharge disable threshold value $\Delta_t=(\phi(2r)-L)$ is multiplied by $\beta$ according to the discharge order and is changed to a discharge disable threshold value $\Delta_t=\beta\times(\phi(2r)-L)$.

(S72) The control device 92 substitutes $\gamma\times\Delta_t$ into the discharge disable threshold value $\Delta_t$ and proceeds to Step S74. That is, in Step S70, the discharge disable threshold value $\Delta_t=(\phi(2r)-L)$ is multiplied by $\gamma$ according to the discharge order and is changed to a discharge disable threshold value $\Delta_t=\gamma\times(\phi(2r)-L)$.

(S74) The control device 92 calculates the difference between the amount of deviation $\Delta_{(i)}$ of the landing position of an ink droplet discharged from the nozzle $72_{(i)}$ with serial number i and the amount of deviation $\Delta_{(i+1)}$ of the landing position of an ink droplet adjacent to the ink droplet discharged from the nozzle $72_{(i)}$. In this embodiment, specifically, the control device 92 subtracts the amount of deviation $\Delta_{(i)}$ of the landing position of the ink droplet discharged from the nozzle $72_{(i)}$ from the amount of deviation $\Delta_{(i+1)}$ of the landing position of the ink droplet discharged from the nozzle $72_{(i+1)}$. Then, the control device 92 determines whether the difference $\Delta_{(i+1)}-\Delta_{(i)}$ between the amounts of deviation of the landing position is greater than the discharge disable threshold value $\Delta_t$. When the determination result is 'Yes', that is, when $\Delta_{(i+1)}-\Delta_{(i)}>\Delta_t$ is satisfied, the control device 92 proceeds to Step S76. When the determination result is 'No', that is, when $\Delta_{(i+1)}-\Delta_{(i)}$ $\Delta_t$ is satisfied, the control device 92 proceeds to Step S78.

In the image forming apparatus according to the second embodiment of the invention, the discharge disable threshold value $\Delta_t$ is changed so as to be sequentially increased by the above-mentioned process in order of when the nozzles $72_{(i-1)}$ and $72_{(i+1)}$ both discharge the ink droplets earlier than the nozzle $72_{(i-2)}$ and $72_{(i+2)}$, when one of the nozzles $72_{(i-1)}$ and $72_{(i+1)}$ discharges the ink droplets earlier than one of the nozzles $72_{(i-2)}$ and $72_{(i+2)}$ and the other of the nozzles $72_{(i-1)}$ and $72_{(i+1)}$ discharge the ink droplets later than the other one of nozzles $72_{(i-2)}$ and $72_{(i+2)}$, and when the nozzles $72_{(i-1)}$ and $72_{(i+1)}$ both discharge the ink droplets later than the nozzles $72_{(i-2)}$ and $72_{(i+2)}$. That is, discharge disable threshold value is changed so as to be sequentially increased to $\Delta_t=\alpha\times(\phi(2r)-L)$, $\Delta_t=\beta\times(\phi(2r)-L)$, and $\Delta_t=\gamma\times(\phi(2r)-L)(\alpha<\beta<\gamma;\ \alpha=1)$. Therefore, it is possible to reduce the number of discharge-disabled nozzles. In addition, when there is a nozzle causing the deviation of the landing position, it is possible to prevent the white lines from being generated.

In the image forming apparatus according to the second embodiment of the invention, the control device 92 determines whether to disable the discharge operation of the nozzle on the basis of the difference $\Delta_{(i+1)}-\Delta_{(i)}$ between the amounts of deviation of the landing position. Therefore, the determination is accurately performed considering the surrounding environment, as compared to a case in which the process of determining whether to disable the discharge operation of the nozzle is performed on the basis of the amount of deviation $\Delta_{(i)}$ of the landing position, and an image defect is presented.

<Modifications>

A plurality of embodiments of the invention have been described in detail, but the invention is not limited to the embodiments. It will be apparent to those skilled in the art that various other embodiments may be made within the scope of the disclosed invention. The plurality of embodiments or modifications may be appropriately combined with each other.

For example, in this embodiment, the single-path ink jet recording apparatus 10 is given as an example of the image forming apparatus. However, the image forming apparatus may be a so-called shuttle-scanning-type ink jet recording apparatus which performs printing while repeatedly moving the ink jet head. In FIG. 1, the drum, such as the transport drum 40, has the structure in which it can transport two sheets P per cycle (twofold drum). However, the drum may have a structure in which it can transport only one sheet P (onefold drum) or a structure in which it can transport three sheets (threefold drum).

In Step S32 shown in FIG. 8, 0 is substituted into the variable $\Delta_t$ which is the discharge disable threshold value. However, the initial value $\Delta_s$ of the discharge disable threshold value may be substituted. In this case, the control device 92 changes the discharge disable threshold value to $\Delta_t=\alpha\times\Delta_s$ in Step S38, changes the discharge disable threshold value to $\Delta_t=\beta\times\Delta_s$ in Step S40, and changes the discharge disable threshold value to $\Delta_t=\gamma\times\Delta_s$ in Step S42 ($\alpha<\beta<\gamma;\ \alpha=1$).

The control device 92 performs the process of quantifying the amount of deviation of the landing position from Step S10 to Step S16 shown in FIG. 7. However, the disclosed invention is not limited thereto, but an image reading device other than the ink jet recording apparatus 10 may perform the process.

In Steps S10 to S16 shown in FIG. 7, the dot diameter $\phi(2r)$ of the ink droplet may be quantified, in addition to the amount of deviation of the landing position or instead of the amount of deviation (the degree of defective state) of the landing position. When the dot diameter is quantified instead of the amount of deviation of the landing position, the dot diameter $\phi(2r)$ of the ink droplet is compared with a threshold value in Step S44 in the process shown in FIG. 8. That is, in Step S44, when the dot diameter $\phi(2r)$ of the ink droplet is greater than the threshold value, the process proceeds to Step S48. When the dot diameter $\phi(2r)$ of the ink droplet is equal to or less than the threshold value, the process proceeds to Step S46.

In the above-described embodiments, the configuration of standard C, M, Y, and K colors (four colors) is given as an example. However, combinations of the ink droplet colors or the number of colors are not limited to this embodiment, but light ink droplets, dark ink droplets, and ink droplets of special colors may be added, if necessary. For example, an ink jet head which discharges light ink droplets, such as light cyan and light magenta ink droplets, may be added, and the arrangement order of color ink jet heads is not particularly limited.

In the above-described embodiments, the ink jet recording apparatus 10 using ink droplets is given as an example of the image forming apparatus. However, the discharged liquid is not limited to the ink droplets for recording an image and printing letters, but may be applied to various kinds of discharge liquids (liquid droplets) as long as it includes a solvent or a dispersion medium which is soaked into the sheet P.

In the above-described embodiments, the sheet P is given as an example of the recording medium. However, the disclosed invention may be applied to recording media, such as threads, fibers, linens and silks, leather, metal, plastic, glass, wood, and ceramics. For example, the disclosed invention may be applied to an OHP film.

What is claimed is:

1. An image forming apparatus comprising:

a discharge disabling unit configured to disable a discharge operation of a defective nozzle, which is in a defective discharge state, among a plurality of nozzles configured to discharge liquid droplets to a recording medium;

a complement unit configured to complement an image defect using two nozzles on either side of the defective nozzle of which discharge operation is disabled;

a threshold value change unit configured to change a discharge disable threshold value depending on a discharge order between the nozzles which complement the image defect and nozzles adjacent to the nozzles which complement the image defect; and a determination unit configured to determine whether a value obtained by quantifying a degree of defective state of the defective nozzle is greater than the discharge disable threshold value, which has been changed by the threshold value change unit, wherein, in a case where the determination unit determines that the value obtained by quantifying the degree of defective state of the defective nozzle is greater than the discharge disable threshold value, which has been changed by the threshold value change unit, the discharge disabling unit disables the discharge operation of the defective nozzle.

2. The image forming apparatus according to claim 1, further comprising:

a quantification unit configured to detect the defective nozzle among the plurality of nozzles and to quantify the degree of defective state of the defective nozzle, wherein, when the two nozzles on either side of the defective nozzle both discharge the liquid droplets later than the nozzles adjacent to the two nozzles on either side of the defective nozzle, the threshold value change unit changes the discharge disable threshold value to be greater than that when the two nozzles on either side of the defective nozzle both discharge the liquid droplets earlier than the nozzles adjacent to the two nozzles on either side of the defective nozzle.

3. The image forming apparatus according to claim 2, wherein, when one of the two nozzles on either side of the defective nozzle discharges the liquid droplets earlier than the nozzle adjacent to the one of the two nozzles on either side of the defective nozzle and an other of the two nozzles on either side of the defective nozzle discharges the liquid droplets later than the nozzle adjacent to the other one of the two nozzles on either side of the defective nozzle, the threshold value change unit changes the discharge disable threshold value to be greater than that when the two nozzles on either side of the defective nozzle both discharge the liquid droplets earlier than the nozzles adjacent to the two nozzles on either side of the defective nozzle and to be less than that when the two nozzles on either side of the defective nozzle both discharge the liquid droplets later than the nozzles adjacent to the two nozzles on either side of the defective nozzle.

4. The image forming apparatus according to claim 2, wherein the quantification unit quantifies an amount of deviation of a landing position of the liquid droplet on the recording medium as the degree of the defective state of the defective nozzle.

5. The image forming apparatus according to claim 3, wherein the quantification unit quantifies an amount of deviation of a landing position of the liquid droplet on the recording medium as the degree of the defective state of the defective nozzle.

6. The image forming apparatus according to claim 2, wherein the quantification unit quantifies a difference between an amount of deviation of a landing position of the liquid droplet on the recording medium and the amount of deviation of a landing position of the liquid droplet adjacent to the landing position as the degree of the defective state of the defective nozzle.

7. The image forming apparatus according to claim 3, wherein the quantification unit quantifies a difference between an amount of deviation of a landing position of the liquid droplet on the recording medium and the amount of deviation of a landing position of the liquid droplet adjacent to the landing position as the degree of the defective state of the defective nozzle.

8. The image forming apparatus according to claim 4, wherein, when the amount of deviation of the landing position of the liquid droplet discharged from an i-th nozzle among the plurality of nozzles is $\Delta_{(i)}$, an initial value of the discharge disable threshold value $\Delta_t$ is $\Delta_s$, rates of increase of the discharge disable threshold value are $\alpha$, $\beta$ and $\gamma$, $\alpha<\beta<\gamma$ is satisfied, and $\alpha$ is 1, the threshold value change unit changes the discharge disable threshold value to $\Delta_t=\alpha\times\Delta_s$ if the two nozzles on either side of the defective nozzle both discharge the liquid droplets earlier than the nozzles adjacent to the two nozzles on either side of the defective nozzle, changes the discharge disable threshold value to $\Delta_t=\beta\times\Delta_s$ if one of the two nozzles on either side of the defective nozzle discharges the liquid droplets earlier than the nozzle adjacent to the one of the two nozzles on either side of the defective nozzle and the other of the two nozzles on either side of the defective nozzle discharges the liquid droplets later than the nozzle adjacent to the other one of the two nozzles on either side of the defective nozzle, and changes the discharge disable threshold value to $\Delta_t=\gamma\times\Delta_s$ if the two nozzles on either side of the defective nozzle both discharge the liquid droplets later than the nozzles adjacent to the two nozzles on either side of the defective nozzle, and the discharge disabling unit disables the discharge operation of the i-th nozzle when $\Delta_{(i)}>\Delta_t$ is satisfied.

9. The image forming apparatus according to claim 5, wherein, when the amount of deviation of the landing position of the liquid droplet discharged from an i-th nozzle among the plurality of nozzles is $\Delta_{(i)}$, an initial value of the discharge disable threshold value $\Delta_t$ is $\Delta_s$, and rates of increase of the discharge disable threshold value are $\alpha$, $\beta$ and $\gamma$, $\alpha<\beta<\gamma$ is satisfied, and $\alpha$ is 1, the threshold value change unit changes the discharge disable threshold value to $\Delta_t=\alpha\times\Delta_s$ if the two nozzles on either side of the defective nozzle both discharge the liquid droplets earlier than the nozzles adjacent to the two nozzles on either side of the defective nozzle, changes the discharge disable threshold value to $\Delta_t=\beta\times\Delta_s$ if one of the two nozzles on either side of the defective nozzle discharges the liquid droplets earlier than the nozzle adjacent to the one of the two nozzles on either side of the defective nozzle and the other of the two nozzles on either side of the defective nozzle discharges the liquid droplets later than the nozzle adjacent to the other one of the two nozzles on either side of the defective nozzle, and changes the discharge disable threshold value to $\Delta_t=\gamma\times\Delta_s$ if the two nozzles on either side of the defective nozzle both discharge the liquid droplets later than the nozzles adjacent to the two nozzles on either side of the defective nozzle, and the discharge disabling unit disables the discharge operation of the i-th nozzle when $\Delta_{(i)}>\Delta_t$ is satisfied.

10. The image forming apparatus according to claim 6, wherein, when the amount of deviation of the landing position of the liquid droplet discharged from an i-th nozzle among the plurality of nozzles is $\Delta_{(i)}$, a dot diameter of the liquid droplet is $\phi(2r)$, a distance between the nozzles is L, the rates of increase of the discharge disable threshold value $\Delta_t$ are $\alpha$, $\beta$ and $\gamma$, $\alpha<\beta<\gamma$ is satisfied, and $\alpha$ is 1, the threshold value change unit changes the discharge disable threshold value to $\Delta_t=\alpha\times(\phi(2r)-L)$ if the two nozzles on either side of the defective nozzle both discharge the liquid droplets earlier than the nozzles adjacent to the two nozzles on either side of the defective nozzle, changes the discharge disable threshold value to $\Delta_t=\beta\times(\phi(2r)-L)$ if one of the two nozzles on either side of the defective nozzle discharges the liquid droplets earlier than the nozzle adjacent to the one of the two nozzles on either side of the defective nozzle and the other of the two nozzles on either side of the defective nozzle discharges the liquid droplets later than the nozzle adjacent to the other one of the two nozzles on either side of the defective nozzle, and changes the discharge disable threshold value to $\Delta_t=\gamma\times(\phi(2r)-L)$ if the two nozzles on either side of the defective nozzle both discharge the liquid droplets later than the nozzles adjacent to the two nozzles on either side of the defective nozzle, and the discharge disabling unit disables the discharge operation of the i-th nozzle when $\Delta_{(i+1)}-\Delta_{(i)}>\Delta_t$ is satisfied.

11. The image forming apparatus according to claim 7, wherein, when the amount of deviation of the landing position of the liquid droplet discharged from an i-th nozzle among the plurality of nozzles is $\Delta_{(i)}$, a dot diameter of the liquid droplet is $\phi(2r)$, a distance between the nozzles is L, the rates of increase of the discharge disable threshold value A are $\alpha$, $\beta$ and $\gamma$, $\alpha<\beta<\gamma$ is satisfied, and $\alpha$ is 1, the threshold value change unit changes the discharge disable threshold value to $\Delta_t=\alpha\times(\phi(2r)-L)$ if the two nozzles on either side of the defective nozzle both discharge the liquid droplets earlier than the nozzles adjacent to the two nozzles on either side of the defective nozzle, changes the discharge disable threshold value to $\Delta_t=\beta\times(\phi(2r)-L)$ if one of the two nozzles on either side of the defective nozzle discharges the liquid droplets earlier than the nozzles adjacent to the one of the two nozzles on either side of the defective nozzle and the other of the two nozzles on either side of the defective nozzle discharges the liquid droplets later than the nozzle adjacent to the other one of the two nozzles on either side of the defective nozzle, and changes the discharge disable threshold value to $\Delta_t=\gamma\times(\phi(2r)-L)$ if the two nozzles on either side of the defective nozzle both discharge the liquid droplets later than the nozzles adjacent to the two nozzles on either side of the defective nozzle, and the discharge disabling unit disables the discharge operation of the i-th nozzle when $\Delta_{(i+1)}-\Delta_{(i)}>\Delta_t$ is satisfied.

12. An image forming method comprising:

detecting a defective nozzle, which is in a defective discharge state, among a plurality of nozzles configured to discharge liquid droplets to a recording medium;

quantifying a degree of defective state of the defective nozzle;

disabling a discharge operation of the defective nozzle;

complementing an image defect using two nozzles on either side of the defective nozzle of which discharge operation is disabled; and changing the discharge disable threshold value depending on a discharge order between the two nozzles which complement the image defect and nozzles adjacent to the two nozzles which complement the image defect, before the disabling of the discharge operation; and determining whether a value obtained by quantifying the degree of the defective state of the defective nozzle is greater than the discharge disable threshold value, which has been changed in the changing the discharge disable threshold value, wherein, the disabling of the discharge operation of the defective nozzle is performed in a case the determining determines the value obtained by quantifying the degree of the defective state of the defective nozzle is greater than the discharge disable threshold value, which has been changed in the changing the discharge disable threshold value.

* * * * *